US008397534B2

(12) United States Patent
Doty et al.

(10) Patent No.: US 8,397,534 B2
(45) Date of Patent: Mar. 19, 2013

(54) HIGH CAPACITY CHILLER COMPRESSOR

(75) Inventors: Mark C. Doty, Stuarts Draft, VA (US); Earl A. Campaigne, Jr., Waynesboro, VA (US); Thomas E. Watson, Staunton, VA (US); Paul K. Butler, Keswick, VA (US); Quentin E. Cline, Swoope, VA (US); Samuel J. Showalter, Verona, VA (US)

(73) Assignee: AFF-McQuay Inc., Minneapolis, MN (US)

( * ) Notice: Subject to any disclaimer, the term of this patent is extended or adjusted under 35 U.S.C. 154(b) by 1041 days.

(21) Appl. No.: 12/404,040

(22) Filed: Mar. 13, 2009

(65) Prior Publication Data

US 2009/0229280 A1 Sep. 17, 2009

Related U.S. Application Data

(60) Provisional application No. 61/069,282, filed on Mar. 13, 2008.

(51) Int. Cl.
*F25B 39/04* (2006.01)
*F04B 39/02* (2006.01)

(52) U.S. Cl. ..... 62/505; 417/366; 62/468

(58) Field of Classification Search ..... 62/505, 62/122, 469, 508, 512, 513, 468, 84, 192, 62/193; 417/366
See application file for complete search history.

(56) References Cited

U.S. PATENT DOCUMENTS

| | | | | |
|---|---|---|---|---|
| 2,453,524 | A | | 11/1948 | McMahan et al. |
| 2,581,709 | A | | 1/1952 | Rogers |
| 2,809,590 | A | | 10/1957 | Brown |
| 3,063,259 | A | | 11/1962 | Hankison et al. |
| 3,158,009 | A | | 11/1964 | Rayner |
| 3,261,172 | A | * | 7/1966 | Grant ..... 62/117 |
| 3,267,868 | A | | 8/1966 | Page |
| 3,306,074 | A | | 2/1967 | Wilson |
| 3,499,388 | A | | 3/1970 | Eberhardt |
| 3,541,875 | A | | 11/1970 | Demorest |
| 3,717,912 | A | | 2/1973 | Lahim |
| 3,945,219 | A | | 3/1976 | Kasahara |
| 4,182,137 | A | | 1/1980 | Erth |
| 4,255,784 | A | | 3/1981 | Rosa |
| 4,275,558 | A | | 6/1981 | Hatch et al. |
| 4,296,539 | A | * | 10/1981 | Asami ..... 29/890.07 |

(Continued)

FOREIGN PATENT DOCUMENTS

| | | |
|---|---|---|
| CN | 2184287 Y | 11/1994 |
| EP | 0 956 634 | 10/2005 |

(Continued)

OTHER PUBLICATIONS

Chinese Office Action of CN200780044367.1, dated Oct. 25, 2010.

(Continued)

*Primary Examiner* — Mohammad Ali
*Assistant Examiner* — Cassey D Bauer
(74) *Attorney, Agent, or Firm* — Patterson Thuente Pedersen, P.A.

(57) ABSTRACT

A high efficiency, low maintenance single stage or multi-stage centrifugal compressor assembly for large cooling installations. A cooling system provides direct, two-phase cooling of the rotor by combining gas refrigerant from the evaporator section with liquid refrigerant from the condenser section to affect a liquid/vapor refrigerant mixture. Cooling of the stator with liquid refrigerant may be provided by a similar technique. A noise suppression system is provided by injecting liquid refrigerant spray at points between the impeller and the condenser section. The liquid refrigerant may be sourced from high pressure liquid refrigerant from the condenser section.

10 Claims, 14 Drawing Sheets

U.S. PATENT DOCUMENTS

| | | | | |
|---|---|---|---|---|
| 4,363,596 | A | 12/1982 | Watson et al. | |
| 4,441,064 | A | 4/1984 | Cutler et al. | |
| 4,503,684 | A | 3/1985 | Mount et al. | |
| 4,609,862 | A | 9/1986 | Becker et al. | |
| 4,616,483 | A | 10/1986 | Leonard | |
| 4,725,206 | A | 2/1988 | Glaser et al. | |
| 4,748,831 | A | 6/1988 | Shaw | |
| 4,786,238 | A | 11/1988 | Glaser et al. | |
| 4,797,448 | A | 1/1989 | Liang | |
| 4,808,069 | A | 2/1989 | Bonner et al. | |
| 4,932,206 | A | 6/1990 | Sawyer et al. | |
| 5,113,669 | A | 5/1992 | Coffinberry | |
| 5,220,809 | A | 6/1993 | Voss | |
| 5,271,248 | A * | 12/1993 | Crowe | 62/505 |
| 5,363,674 | A | 11/1994 | Powell | |
| 5,467,613 | A | 11/1995 | Brasz et al. | |
| 5,499,509 | A | 3/1996 | Harold et al. | |
| 5,506,487 | A | 4/1996 | Young et al. | |
| 5,555,956 | A | 9/1996 | Voss et al. | |
| 5,669,756 | A | 9/1997 | Brasz et al. | |
| 5,747,907 | A | 5/1998 | Miller | |
| 5,857,348 | A | 1/1999 | Conry | |
| 5,924,847 | A | 7/1999 | Scaringe et al. | |
| 6,009,722 | A | 1/2000 | Choi et al. | |
| 6,010,302 | A | 1/2000 | Oeynhausen | |
| 6,039,534 | A | 3/2000 | Stoner et al. | |
| 6,087,744 | A | 7/2000 | Glauning | |
| 6,116,040 | A | 9/2000 | Stark | |
| 6,176,092 | B1 | 1/2001 | Butterworth et al. | |
| 6,194,852 | B1 | 2/2001 | Lovatt et al. | |
| 6,220,341 | B1 | 4/2001 | Izumi et al. | |
| 6,279,340 | B1 | 8/2001 | Butterworth et al. | |
| 6,296,441 | B1 | 10/2001 | Gozdawa | |
| 6,304,011 | B1 | 10/2001 | Pullen et al. | |
| 6,375,438 | B1 | 4/2002 | Seo | |
| 6,390,789 | B1 | 5/2002 | Grob et al. | |
| 6,408,645 | B1 | 6/2002 | Tsuboe et al. | |
| 6,464,469 | B1 | 10/2002 | Grob et al. | |
| 6,484,490 | B1 | 11/2002 | Olsen et al. | |
| 6,519,959 | B2 | 2/2003 | Kim et al. | |
| 6,564,560 | B2 | 5/2003 | Butterworth et al. | |
| 6,579,078 | B2 | 6/2003 | Hill et al. | |
| 6,599,104 | B2 | 7/2003 | Saito et al. | |
| 6,616,421 | B2 | 9/2003 | Mruk et al. | |
| 6,674,187 | B2 | 1/2004 | Isozaki et al. | |
| 6,688,124 | B1 | 2/2004 | Stark et al. | |
| 6,746,215 | B2 | 6/2004 | Tani et al. | |
| 6,958,126 | B2 | 10/2005 | Goble | |
| 7,027,279 | B2 | 4/2006 | Levin et al. | |
| 7,135,828 | B2 | 11/2006 | Lin | |
| 7,156,627 | B2 | 1/2007 | Lenderink et al. | |
| 7,181,928 | B2 | 2/2007 | de Larminat | |
| 7,240,515 | B2 | 7/2007 | Conry | |
| 7,252,474 | B2 | 8/2007 | Belokon et al. | |
| 7,451,616 | B2 | 11/2008 | Ro | |
| 2001/0037651 | A1 | 11/2001 | Butterworth et al. | |
| 2002/0079158 | A1 | 6/2002 | Liu | |
| 2004/0107688 | A1 | 6/2004 | Wuest et al. | |
| 2005/0135126 | A1 | 6/2005 | Gazel et al. | |
| 2005/0223737 | A1 | 10/2005 | Conry | |
| 2005/0284173 | A1 | 12/2005 | de Larminat | |
| 2006/0013707 | A1 | 1/2006 | Oklejas et al. | |
| 2006/0093477 | A1 | 5/2006 | Jones | |
| 2007/0059179 | A1 | 3/2007 | Xu | |
| 2007/0075596 | A1 | 4/2007 | Hall | |
| 2007/0212232 | A1 | 9/2007 | De Larminat | |
| 2008/0115527 | A1 | 5/2008 | Doty et al. | |
| 2008/0199326 | A1 * | 8/2008 | Masoudipour et al. | 417/247 |

FOREIGN PATENT DOCUMENTS

| | | |
|---|---|---|
| EP | 1 063 430 | 5/2007 |
| JP | 2000120595 | 4/2000 |
| KR | 10-1988-7000169 | 2/1998 |
| KR | 10-2006-0081791 | 7/2006 |
| KR | 10-2006-0118432 | 11/2006 |
| KR | 10-0748892 | 10/2007 |
| WO | WO 94/29597 | 12/1994 |
| WO | WO 02/44632 | 6/2002 |
| WO | WO 02/50481 | 6/2002 |
| WO | WO 03/072946 | 9/2003 |

OTHER PUBLICATIONS

Application and File History of U.S. Appl. No. 11/868,341, Inventors Doty et al., filed Oct. 5, 2007.

"2003 Standard for Performance Rating of Water-Chilling Packages Using the Vapor Compression Cycle," Air-Conditioning & Refrigeration Institute, 2003, pp. 1-30.

"Heating, Ventilating, and Air-Conditioning Systems and Equipment," 1996 Ashrae Handbook, 1996, pp. 34.25-34.27American Society of Heating, Refrigerating and Air-Conditioning Engineers, Inc. Atlanta, Georgia.

"Fundamentals," 2005 Ashrae Handbook, 2005, pp. 1.10-1.11, American Society of Heating, Refrigerating and Air-Conditioning Engineers, Inc., Atlanta, Georgia.

Kanki et al., "Development of a High Efficiency Centrifugal Heat Pump with Active Magnetic Bearings," Mitsubishi Heavy Industries, LTD., Feb. 1992, pp. 1-6, Tokyo, Japan.

"Electric Drive for Flexibility on a German Pipeline Booster Station," S2M Bulletin, available at: http://ww.s2m.fr/E//4-APPLICATIONS/jofim.html.

"Onboard a High Speed Train,": S2M Bulletin, available at: http://www.s2m.fr/E/4-APPLICATIONS/air-cond.html.

Carrier, "Evergreen Centrifugal Chillers with Unit-Mounted Variable Frequency Drive" 1999 Carrier Corporation, Syracuse, New York.

International Search Report and Written Opinion, dated Oct. 27, 2009.

Written Opinion of the International Searching Authority for International Application No. PCT/US07/21536, dated Apr. 4, 2008.

Examiner's Report No. 2 on Patent Application No. 2007307051, dated Mar. 23, 2011.

Examiner's Report No. 1 on Patent Application No. 2009223279, dated Aug. 17, 2011.

Examiner's Report No. 3 on Patent Application No. 2007307051, dated Oct. 5, 2011.

The Third Office Action on Patent Application No. 200780044367.1, dated Jul. 12, 2011.

* cited by examiner

HIGH CAPACITY CHILLER COMPRESSOR

RELATED APPLICATION

This application claims the benefit of U.S. Provisional Application No. 61/069,282 filed Mar. 13, 2008, which is hereby fully incorporated by reference.

FIELD OF THE INVENTION

This invention relates generally to the field of compressors. More specifically, the invention is directed to large capacity compressors for refrigeration and air conditioning systems.

BACKGROUND ART

Large cooling installations, such as industrial refrigeration systems or air conditioner systems for office complexes, often involve the use of high cooling capacity systems of greater than 400 refrigeration tons (1400 kW). Delivery of this level of capacity typically requires the use of very large single stage or multi-stage compressor systems. Existing compressor systems are typically driven by induction type motors that may be of the hermetic, semi-hermetic, or open drive type. The drive motor may operate at power levels in excess of 250 kW and rotational speeds in the vicinity of 3600 rpm. Such compressor systems typically include rotating elements supported by lubricated, hydrodynamic or rolling element bearings.

The capacity of a given refrigeration system can vary substantially depending on certain input and output conditions. Accordingly, the heating, ventilation and air conditioning (HVAC) industry has developed standard conditions under which the capacity of a refrigeration system is determined. The standard rating conditions for a water-cooled chiller system include: condenser water inlet at 29.4° C. (85° F.), 0.054 liters per second per kW (3.0 gpm per ton); a water-side condenser fouling factor allowance of 0.044 $m^2$-° C. per kW (0.00025 hr-$ft^2$-° F. per BTU); evaporator water outlet at 6.7° C. (44.0° F.), 0.043 liters per second per kW (2.4 gpm per ton); and a water-side evaporator fouling factor allowance of 0.018 $m^2$-° C. per kW (0.0001 hr-$ft^2$-° F. per BTU). These conditions have been set by the Air-Conditioning and Refrigeration Institute (ARI) and are detailed in ARI Standard 550/590 entitled "2003 Standard for Performance Rating of Water-Chilling Packages Using the Vapor Compression Cycle," which is hereby incorporated by reference other than any express definitions of terms specifically defined. The tonnage of a refrigeration system determined under these conditions is hereinafter referred to as "standard refrigeration tons."

In a chiller system, the compressor acts as a vapor pump, compressing the refrigerant from an evaporation pressure to a higher condensation pressure. A variety of compressors have found utilization in performing this process, including rotary, screw, scroll, reciprocating, and centrifugal compressors. Each compressor has advantages for various purposes in different cooling capacity ranges. For large cooling capacities, centrifugal compressors are known to have the highest isentropic efficiency and therefore the highest overall thermal efficiency for the chiller refrigeration cycle. See U.S. Pat. No. 5,924,847 to Scaringe, et al.

Typically, the motor driving the compressor is actively cooled, especially with high power motors. With chiller systems, the proximity of refrigerant coolant to the motor often makes it the medium of choice for cooling the motor. Many systems feature bypass circuits designed to adequately cool the motor when the compressor is operating at full power and at an attendant pressure drop through the bypass circuit. Other compressors, such as disclosed by U.S. Pat. No. 5,857,348 to Conry, link coolant flow through the bypass circuit to a throttling device that regulates the flow of refrigerant into the compressor. Furthermore, U.S. Patent Application Publication 2005/0284173 to de Larminat discloses the use of vaporized (uncompressed) refrigerant as the cooling medium. However, such bypass circuits suffer from inherent shortcomings.

Some systems cool several components in series, which limits the operational range of the compressor. The cooling load requirement of each component will vary according to compressor cooling capacity, power draw of the compressor, available temperatures, and ambient air temperatures. Thus, the flow of coolant may be matched properly to only one of the components in series, and then only under specific conditions, which can create scenarios where the other components are either over-cooled or under cooled. Even the addition of flow controls cannot mitigate the issues since the cooling flow will be determined by the device needing the most cooling. Other components in the series will be either under-cooled or over cooled. Over cooled components may form condensation if exposed to ambient air. Under-cooled devices may exceed their operational limits resulting in component failure or unit shut down. Another limitation of such systems may be a need for a certain minimum pressure difference to push the refrigerant through the bypass circuit. Without this minimum pressure, the compressor may be prevented from operating or limited in the allowed operating envelope. A design is therefore desired which provides the capability for a wide operating range.

Centrifugal compressors are also often characterized as having undesirable noise characteristics. The noise comes from the wakes created by the centrifugal impeller blades as they compress the refrigerant gas. This is typically referred to as the "blade pass frequency." Another source of noise is the turbulence present in the high speed gas between the compressor and the condenser. Noise effects are particularly prevalent in large capacity systems.

Another characteristic of existing large capacity centrifugal compressors designs is the weight and size of the assembly. For example, the rotor of a typical induction motor can weigh hundreds of pounds, and may exceed 1000 pounds. Compressor assemblies having capacities of 200 standard refrigeration tons can weigh in excess of 3000 pounds. Also, as systems are developed that exceed existing horsepower and refrigerant tonnage capacity, the weight and size of such units may become problematic with regard to shipping, installation and maintenance. When units are mounted above ground level, weight may go beyond problematic to prohibitive because of the expense of providing additional structural support. Further, the space needed to accommodate one of these units can be significant.

There is a long felt need in the HVAC industry to increase the capacity of chiller systems. Evidence of this need is underscored by continually increasing sales of large capacity chillers. In the year 2006, for example, in excess of 2000 chiller systems were sold with compressor capacities greater than 200 standard refrigeration tons. Accordingly, the development of a compressor system that overcomes the foregoing problems and design challenges for delivery of refrigeration capacities substantially greater than the existing or previously commercialized systems would be welcome.

SUMMARY OF THE INVENTION

The various embodiments of the invention include single stage and multi-stage centrifugal compressor assemblies designed for large cooling installations. These embodiments provide an improved chiller design utilizing an advantageous cooling arrangement, such as a two-phase cooling arrangement and other features to enhance power output and efficiency, improve reliability, and reduce maintenance requirements. In various embodiments, the characteristics of the design allow a small and physically compact compressor. Further, in various embodiments, the disclosed design makes use of a sound suppression arrangement which provides a compressor with sought-after noise reducing properties as well.

The variables in designing a high capacity chiller compressor include the diameter and length of the rotor and stator assemblies and the materials of construction. A design tradeoff exists with respect to the diameter of the rotor assembly. On the one hand, the rotor assembly has to have a large enough diameter to meet the torque requirement. On the other hand, the diameter should not be so great as to generate surface stresses that exceed typical material strengths when operating at high rotational speeds, which may exceed 11,000 rpm in certain embodiments of the invention, approaching 21,000 rpm in some instances. Also, larger diameters and lengths of the rotor assembly may produce aerodynamic drag forces (aka windage) proportional to the length and to the square of the diameter of the rotor assembly in operation, resulting in more losses. The larger diameters and lengths may also tend to increase the mass and the moment of inertia of the rotor assembly when standard materials of construction are used.

Reduction of stress and drag tends to promote the use of smaller diameter rotor assemblies. To produce higher power capacity within the confines of a smaller diameter rotor assembly, some embodiments of the invention utilize a permanent magnet (PM) motor. Permanent magnet motors are well suited for operation above 3600 rpm and exhibit the highest demonstrated efficiency over a broad speed and torque range of the compressor. PM motors typically produce more power per unit volume than do conventional induction motors and are well suited for use with VFDs. Additionally, the power factor of a PM motor is typically higher and the heat generation typically less than for induction motors of comparable power. Thus, the PM motor provides enhanced energy efficiency over induction motors.

However, further increase in the power capacity within the confines of the smaller diameter rotor assembly creates a higher power density with less exterior surface area for the transfer of heat generated by electrical losses. Accordingly, large cooling applications such as industrial refrigeration systems or air conditioner systems that utilize PM motors are typically limited to capacities of 200 standard refrigeration tons (700 kW) or less.

To address the increase in power density, various embodiments of the invention utilize refrigerant gas from the evaporator section to cool the rotor and stator assemblies. Still other embodiments further include internal cooling of the motor shaft, which increases the heat transfer area and can increase the convective coupling of the heat transfer coefficient between the refrigerant gas and the rotor assembly.

The compressor may be configured to include a cooling system that cools the motor shaft/rotor assembly and the stator assembly independently, avoiding the disadvantages inherent to serial cooling of these components. Each circuit may be adaptable to varying cooling capacity and operating pressure ratios that maintains the respective components within temperature limits across a range of speeds without over-cooling or under-cooling the motor. Embodiments include a cooling or bypass circuit that passes a refrigerant gas or a refrigerant gas/liquid mixture through the motor shaft as well as over the outer perimeter of the rotor assembly, thereby providing two-phase cooling of the rotor assembly by direct conduction to the shaft and by convection over the outer perimeter. Further, due to a rotor pumping effect, the need for a certain minimum pressure difference to push the refrigerant through the bypass circuit is alleviated. The compressor is able to provide the capability of a wide operating envelope, even without a significant pressure difference between condenser and evaporator.

The compressor may be fabricated from lightweight components and castings, providing a high power-to-weight ratio. The low weight components in a single or multi-stage design enables the same tonnage at approximately one-third the weight of conventional units. The weight reduction differences may be realized through the use of aluminum or aluminum alloy components or castings, elimination of gears, and a smaller motor.

In one embodiment, a chiller system is disclosed comprising a centrifugal compressor assembly for compression of a refrigerant in a refrigeration loop. The refrigeration loop includes an evaporator section containing refrigerant gas and a condenser section that contains refrigerant liquid. The centrifugal compressor includes a motor housed within a motor housing, the motor housing defining an interior chamber. The motor in this embodiment includes a motor shaft rotatable about a rotational axis and a rotor assembly operatively coupled with a portion of the motor shaft. The motor shaft may include at least one longitudinal passage and at least one aspiration passage, the at least one longitudinal passage extending substantially parallel with the rotational axis through at least the portion of the motor shaft. The at least one aspiration passage being in fluid communication with the interior chamber or the motor housing and with the at least one longitudinal passage. In this embodiment, the evaporator section is in fluid communication with the at least one longitudinal passage for supply of the refrigerant gas that cools the motor shaft and the rotor assembly. In this embodiment, the condenser section is in fluid communication with the at least one longitudinal passage for supply of the refrigerant liquid. Additionally, a flow restriction device is disposed between the condenser section and the at least one longitudinal passage for expansion of the refrigerant liquid.

In another embodiment, a chiller system is disclosed with a compressor assembly including a motor and an aerodynamic section, the motor including a motor shaft, a rotor assembly and a stator assembly. A condenser section may be in fluid communication with the compressor assembly, and an evaporator section may be in fluid communication with the condenser section and the compressor assembly. The compressor assembly may further include a rotor cooling circuit having a gas cooling inlet operatively coupled with the evaporator section. The compressor assembly having a liquid cooling inlet operatively coupled with the condenser section. The compressor assembly also having an outlet operatively coupled with the evaporator section. The compressor assembly may also include a stator cooling circuit having a liquid cooling inlet port operatively coupled with the condenser section. Further, the compressor assembly may also include a liquid cooling outlet port operatively coupled with the evaporator section.

In yet another embodiment, a chiller system is disclosed that includes a compressor assembly including a motor and an aerodynamic section. The motor including a rotor assembly operatively coupled with a motor shaft and a stator assembly to produce rotation of the motor shaft. The motor shaft and the aerodynamic section arranged for direct drive of the aerodynamic section. A condenser section and an evaporator section are each operatively coupled with the aerodynamic section, where the condenser section has a higher operating pressure than the evaporator section. The chiller system may also include both a liquid bypass circuit and a gas bypass circuit. The liquid bypass circuit cools the stator assembly and the rotor assembly with a liquid refrigerant supplied by the condenser section and returned to the evaporator section, the liquid refrigerant being motivated through the liquid bypass circuit by the higher operating pressure of the condenser section relative to the evaporator section. The gas bypass circuit cools the rotor assembly with a gas refrigerant, the gas refrigerant being drawn from the evaporator section and returned to the evaporator section by pressure differences caused by the rotation of the motor shaft.

Other embodiments of the invention include a chiller system with a compressor assembly having an impeller contained within an aerodynamic housing. The compressor assembly further including a compressor discharge section through which a discharged refrigerant gas may be funneled between the aerodynamic housing and a condenser section. The compressor discharge section further includes liquid injection locations from which liquid refrigerant is injected. This liquid refrigerant may be sourced from the condenser section. The injected liquid refrigerant traverses a flow cross-section of the discharged refrigerant gas locally and forms a concentrated mist of refrigerant droplets suspended in a refrigerant gas to dampen noises from the impeller.

Other embodiments may further include a centrifugal compressor assembly of compact size for compression of a refrigerant in a refrigeration loop. The compressor assembly including a motor housing containing a permanent magnet motor, where the motor housing defines an interior chamber. The permanent magnet motor may include a motor shaft being rotatable about a rotational axis and a rotor assembly operatively coupled with a portion of the motor shaft. The permanent magnet motor may be adapted to provide power exceeding 140 kW, produce speeds in excess of 11,000 revolutions per minute, and exceed a 200-ton refrigeration capacity at standard industry rating conditions. In one embodiment, the centrifugal compressor assembly having such capabilities weighs less than approximately 365-kg (800-lbf) to 1100-kg (2500-lbf) and is sized to fit within a space having dimensions of approximately 115-cm (45-in.) length by 63-cm (25-in.) height by 63-cm (25-in.) width.

Other embodiments may further include a method for operation of a high capacity chiller system. The method includes providing a centrifugal compressor assembly for compression of a refrigerant in a refrigeration loop. The refrigeration loop includes an evaporator section containing a refrigerant gas and a condenser section containing a refrigerant liquid. The centrifugal compressor includes a rotor assembly operatively coupled with a stator assembly. The rotor assembly includes structure that defines a flow passage therethrough, and the centrifugal compressor includes a refrigerant mixing assembly operatively coupled with the evaporator section, the condenser section and the rotor assembly. The method also includes transferring said refrigerant liquid from the condenser section to the refrigerant mixing assembly and transferring the refrigerant gas from the evaporator section to the refrigerant mixing assembly. Finally, the method includes using the refrigerant mixing assembly to mix said refrigerant liquid with the refrigerant gas from the steps of transferring to produce a gas-liquid refrigerant mixture; and routing the gas-liquid refrigerant mixture through the flow passage of the rotor assembly to provide two-phase cooling of the rotor assembly.

BRIEF DESCRIPTION OF THE DRAWINGS

FIGS. 8A through 8C are enlarged sectional views of a spiral passageway that may be utilized in the liquid bypass circuit of FIG. 8.

DETAILED DESCRIPTION OF THE EMBODIMENTS

Figure 1:
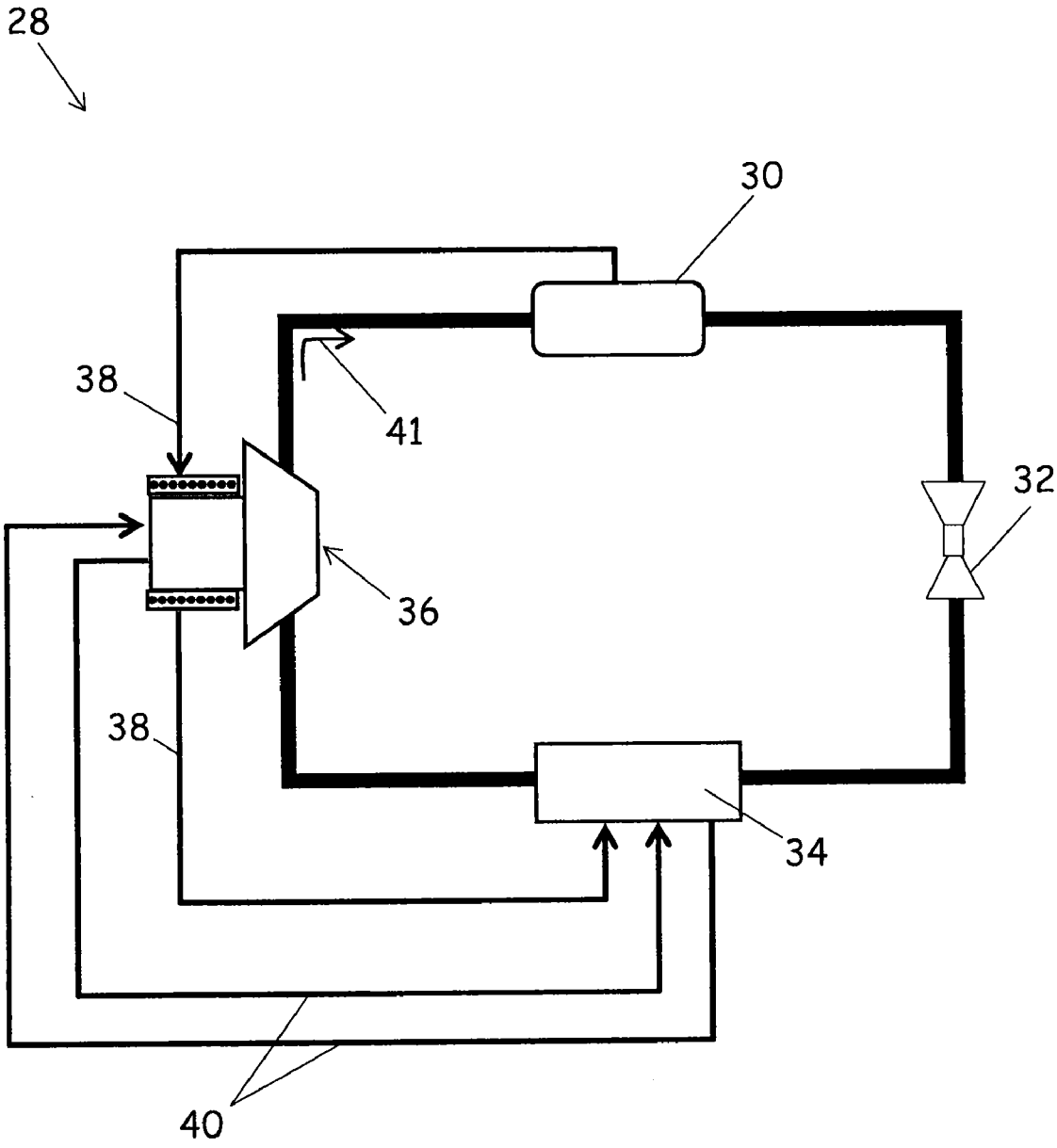
FIG. 1 is a schematic of a chiller system in an embodiment of the invention.

Referring to FIG. 1, a chiller system 28 having a condenser section 30, an expansion device 32, an evaporator section 34 and a centrifugal compressor assembly 36 is depicted in an embodiment of the invention. The chiller system 28 may be further characterized by a liquid bypass circuit 38 and a gas bypass circuit 40 for cooling various components of the centrifugal compressor assembly 36.

In operation, refrigerant within the chiller system 28 is driven from the centrifugal compressor assembly 36 to the condenser section 30, as depicted by the directional arrow 41, setting up a clockwise flow as to FIG. 1. The centrifugal compressor assembly 36 causes a boost in the operating pressure of the condenser section 30, whereas the expansion device 32 causes a drop in the operating pressure of the evaporator section 34. Accordingly, a pressure difference exists during operation of the chiller system 28 wherein the operating pressure of the condenser section 30 may be higher than the operating pressure of the evaporator section 34.

Figure 2:
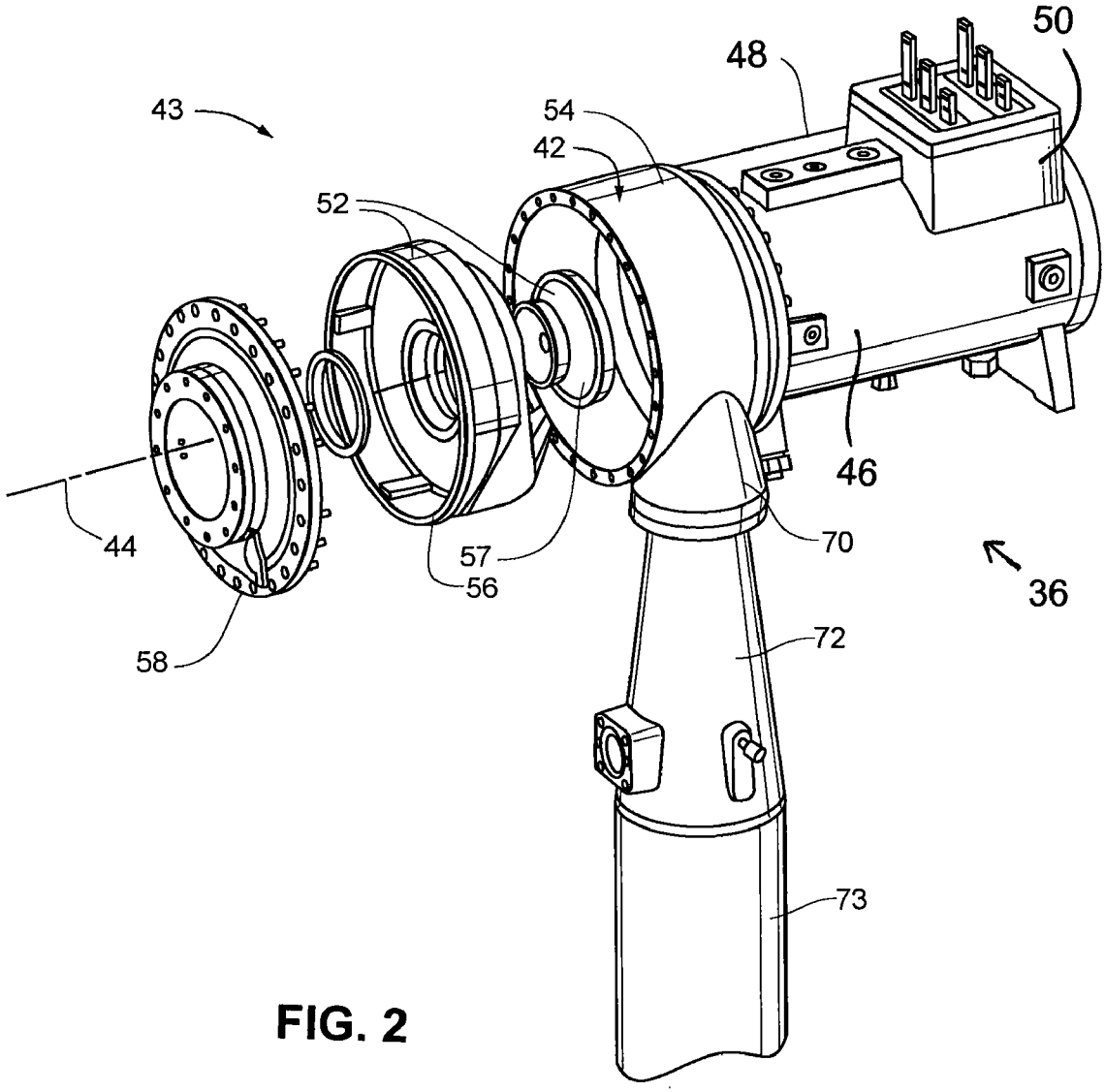
FIG. 2 is a partially exploded perspective view of a compressor assembly in an embodiment of the invention.
Figure 3:
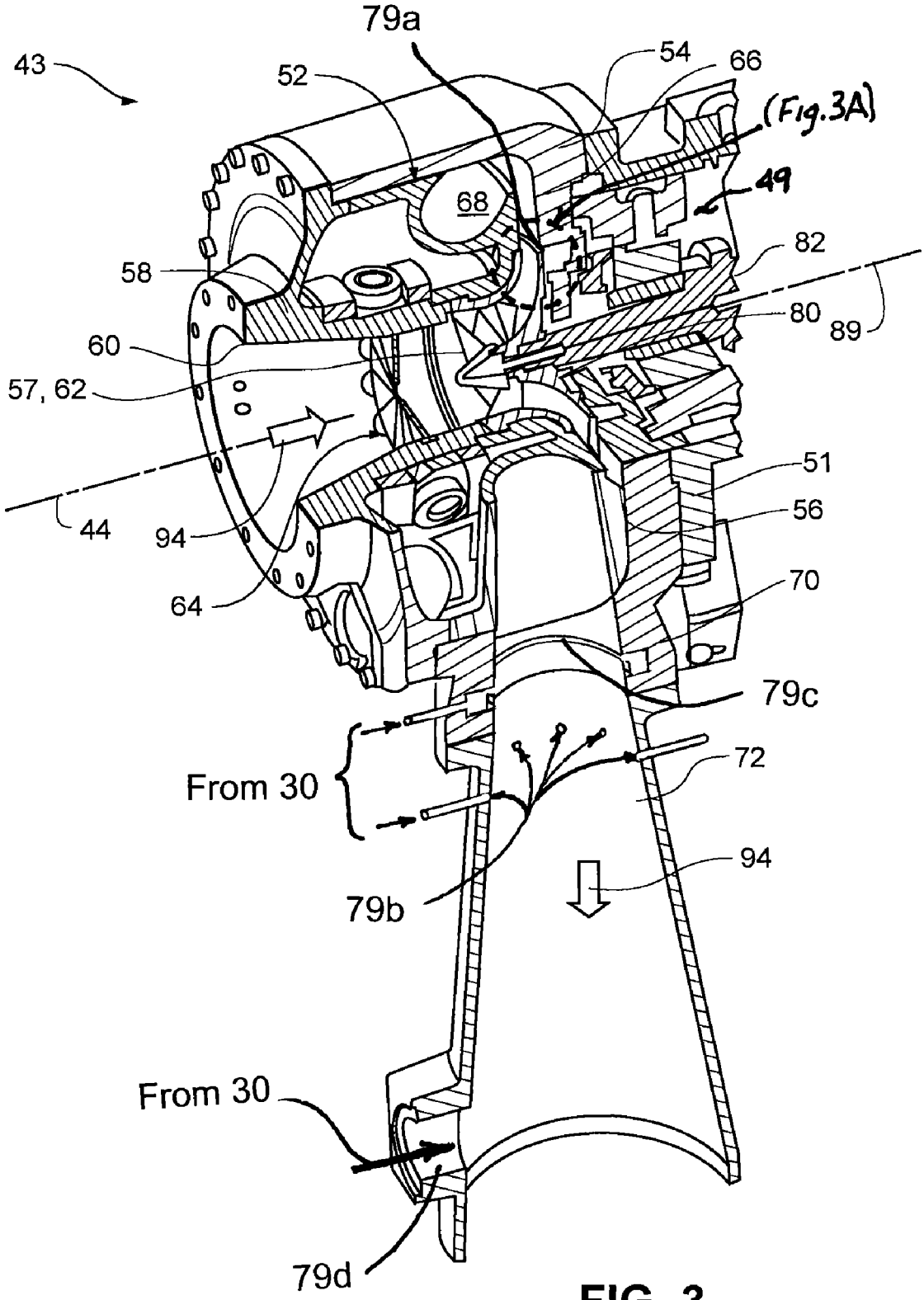
FIG. 3 is a perspective cut away view of an aerodynamic section of a single stage compressor assembly in an embodiment of the invention.

Referring to FIGS. 2 and 3, an embodiment of a centrifugal compressor assembly 36 according to the invention is depicted. The centrifugal compressor assembly 36 includes an aerodynamic section 42 of a single stage compressor 43 having a central axis 44, a motor housing 46, an electronics compartment 48 and an incoming power terminal enclosure 50. It is contemplated that that a multi-stage compressor could readily be used in place of the single stage compressor 43. The motor housing 46 generally defines an interior chamber 49 for containment and mounting of various components of the compressor assembly 36. Coupling between the motor housing 46 and the aerodynamic section 42 may be provided by a flanged interface 51.

In one embodiment, the aerodynamic section 42 of the single stage compressor 43, portrayed in FIG. 3, contains a centrifugal compressor stage 52 that includes a volute insert 56 and an impeller 80 within an impeller housing 57. The centrifugal compressor stage 52 may be housed in a discharge housing 54 and in fluid communication with an inlet housing 58.

The inlet housing 58 may provide an inlet transition 60 between an inlet conduit (not depicted) and an inlet 62 to the compressor stage 52. The inlet conduit may be configured for mounting to the inlet transition 60. The inlet housing 58 can also provide structure for supporting an inlet guide vane assembly 64 and serves to hold the volute insert 56 against the discharge housing 54.

In some embodiments, the volute insert 56 and the discharge housing 54 cooperate to form a diffuser 66 and a volute 68. The discharge housing 54 can also be equipped with an exit transition 70 in fluid communication with the volute 68. The exit transition 70 can be interfaced with a discharge nozzle 72 that transitions between the discharge housing 54 and a downstream conduit 73 (FIG. 2) that leads to the condenser section 30. A downstream diffusion system may be operatively coupled with the impeller 80, and may comprise the diffuser 66, the volute 68, transition 70 and the discharge nozzle 72.

The discharge nozzle 72 may be made from a weldable cast steel such as ASTM A216 grade WCB. The various housings 54, 56, 57 and 58 may be fabricated from steel, or from high strength aluminum alloys or light weight alloys to reduce the weight of the compressor assembly 36.

The aerodynamic section 42 may include one or more liquid refrigerant injection locations (e.g., 79*a* through 79*d*), such as depicted in FIG. 3. Generally, the liquid refrigerant injection locations 79 may be positioned anywhere between the impeller housing 57 and the condenser section 30. The flow passages between the impeller housing 57 and condenser section 30 may be referred to as the compressor discharge section. In the depicted embodiment of FIG. 3, location 79*a* is at or near the inlet to the diffuser 66, locations 79*b* and 79*c* are near the junction of the transition 70 and the discharge nozzle 72, and location 79*d* is near the exit of the discharge nozzle 72.

The liquid injection may be accomplished by a single spray point, circumferentially spaced spray points (e.g. 79*b*), a circumferential slot (e.g. 79*a*, 79*c*), or by other configurations that provide a droplet spray that traverses at least a portion of the flow cross-section. Accordingly, a concentrated mist comprising refrigerant droplets suspended in refrigerant gas is provided to dampen noises from the impeller.

In one embodiment, the liquid refrigerant injection locations 79 are sourced by the high pressure liquid refrigerant in the condenser section 30. Accordingly, the further the injection location is from the impeller housing 57, the less the pressure difference between the liquid refrigerant injection locations 79 and the condenser section 30 because of the pressure recovery of the downstream diffusion system.

In operation, liquid refrigerant from the condenser section 30 is injected into the liquid refrigerant injection locations 79, traversing the flow cross-section locally. The traversing, droplet-laden flow can act as a curtain that dampens noises emanating from the impeller housing 57, such as blade pass frequency. Suppression of noise can reduce the overall sound pressure level by more than six db in some instances.

Figure 3A:
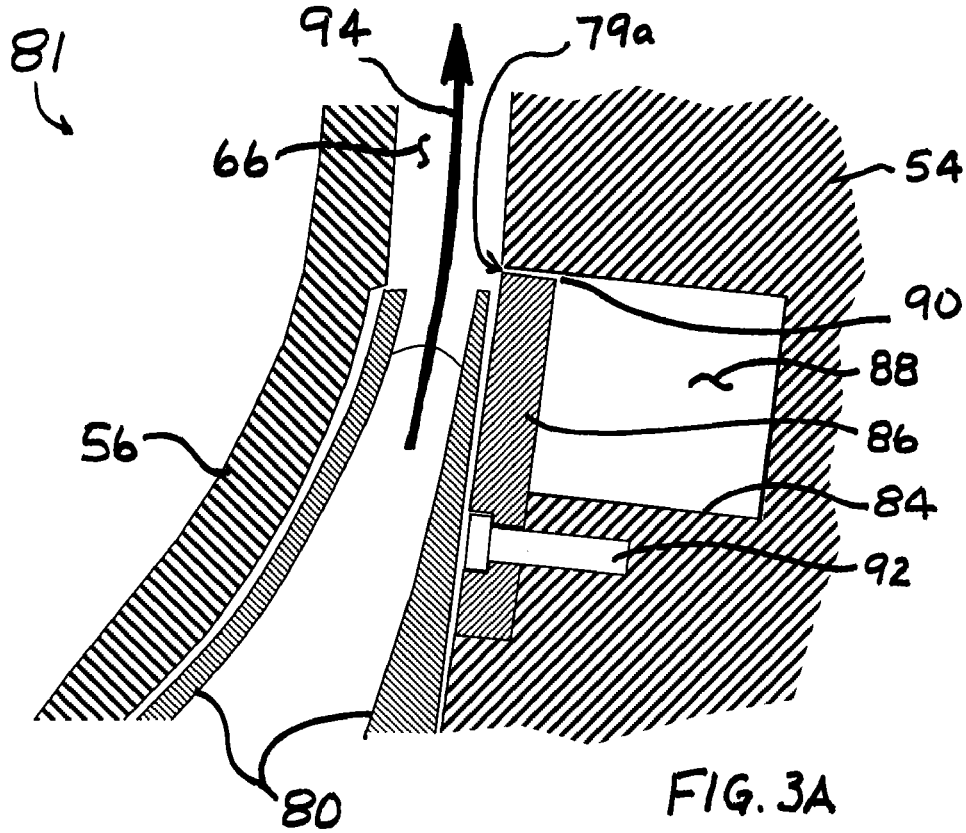
FIG. 3A is an enlarged partial sectional view of a slot injector located at the diffuser of the aerodynamic section of FIG. 3 in an embodiment of the invention.

Referring to FIG. 3A, a slot injector 81 located at the impeller exit (location 79*a*) is depicted in an embodiment of the invention. In this embodiment, the slot injector 81 comprises an annular channel 84 formed in the discharge housing 54 and a cover ring 86 that cooperate to define a plenum 88 and an arcuate slot 90. The arcuate slot 90 may be circular and continuous about the perimeter of the impeller 80. The cover ring 86 may be affixed to the discharge housing 54 with a fastener 92. The arcuate slot 90 provides fluid communication between the plenum 88 and the diffuser 66. A representative and non-limiting range of dimensions for a circular, continuous arcuate slot 90 is approximately 7- to 50-cm diameter, 3- to 20-mm flow path length, and 0.02- to 0.4-mm width, where the flow path is the dimension to flow through slot (e.g., the thickness of the cover ring 86) and the width is the dimension of the slot normal to the flow path through the slot. length. When implemented at the impeller exit location 79*a*, the slot may be positioned right at the diameter of the impeller or some radial distance outward (e.g., 1.1 diameters).

Figure 3B:
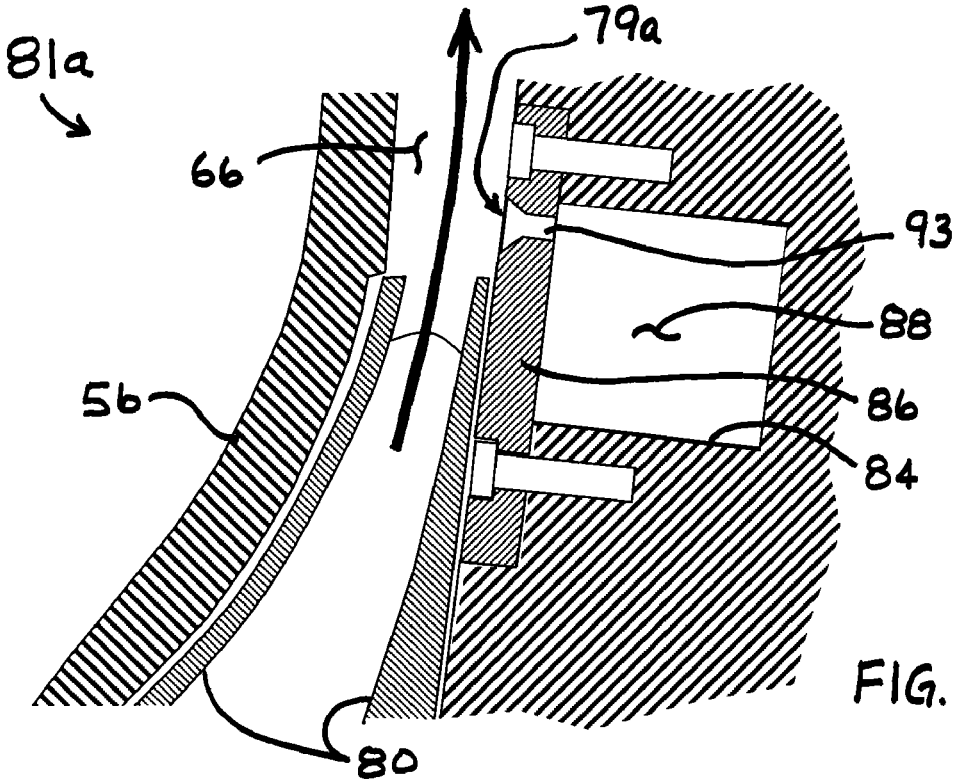
FIG. 3B is an enlarged partial sectional view of an orifice array injector in an embodiment of the invention.

Referring to FIG. 3B, an orifice array injector 81*a* at the impeller exit (location 79*a*) is depicted in an embodiment of the invention. In this embodiment, the cover ring 86 can be designed to cover the annular channel 84 and exit orifices 93 formed through the cover ring 86 to provide fluid communication between the plenum 88 and the diffuser 66. The exit orifices 93 may be of constant diameter, or formed to provide a converging and/or diverging flow passage over at least a portion of the orifice length. (The depiction of FIG. 3A represents a diverging flow passage over a downstream portion of the exit orifice 93.)

The number of orifices in the orifice array injector 81*a* range typically from 10 to 50 orifices, depending on the size of the array injector and limitations of the machining or forming process. The combined minimum flow area (i.e. the area of the smallest cross-section of the exit orifice 93) of the exit orifices may be determined experimentally, and can be normalized as a percentage of the impeller exit flow area. Typically, the larger the impeller exit flow area, the more the spray. The combined minimum flow area of the exit orifices, from which the minimum diameters of the exit orifices 93 are determined, is typically and approximately 0.5% to 3% of the impeller exit flow area. A representative and non-limiting range for the angle of convergence/divergence of the exit orifices 93 is from 15- to 45-degrees as measured from the flow axis, and an orifice length of 3- to 20-mm. Also, spray nozzles or atomizers can be coupled to or formed within the cover ring 86 to deliver an atomized spray to the diffuser 66.

In operation, the plenum 88 operates at a higher pressure than the diffuser 66. The plenum 88 is flooded with liquid refrigerant which may be sourced from the condenser section 30. The higher pressure of the plenum 88 forces liquid refrigerant through the slot 90 and into the low pressure region of the diffuser 66. The resulting expansion of the liquid refrigerant can cause only a portion of the liquid to flash into a vapor phase, leaving the remainder in a liquid state. The remaining liquid refrigerant may form droplets that are sprayed in a flow stream comprising a refrigerant gas 94 as it passes through the diffuser 66. The droplets can act to attenuate noises emanating from the impeller housing 57.

The slot injector 81 enables definition of a curtain of droplets that flows uniformly through the slot over a long lateral length. For embodiments where the arcuate slot is continuous, the curtain is also continuous, providing uniform attenuation of sound without gaps that are inherent to discrete point sprays.

The converging and/or diverging portions of the exit orifice 93 of the orifice array injector 81*a* promotes cross flow of the liquid refrigerant within the exit orifice 93. The cross flow can cause the spray pattern of the liquid refrigerant to fan out as it exits the exit orifice 93, which may result in the spray covering a wider area than with a constant diameter orifice. The wider area coverage tends to enhance the attenuation of noises that propagate from the impeller region.

Placement of the injection location close at location 79*a* provides an increase in the pressure difference across the flow restriction (i.e. the pressure difference between the plenum 88 and the diffuser 66). The main gas flow from the compressor is typically at its highest velocity at or near location 79*a*. Accordingly, the venturi effect that lowers the static pressure of the flow stream is typically greatest at or near location 79*a*, thus enhancing the pressure difference. Although this effect is generally present along the discharge path, it is typically greatest at the inlet to the diffuser 66.

While FIGS. 3A and 3B depict cover rings having planar surfaces with the flow direction being substantially parallel and normal to planar surfaces, it is understood that the slot injector and the orifice array injector are not limited to the depicted geometry. The same concept can be applied to a cylindrical- or frustum-shaped ring, as depicted at location 79*c*, where the flows have a substantial radial component.

Figure 4:
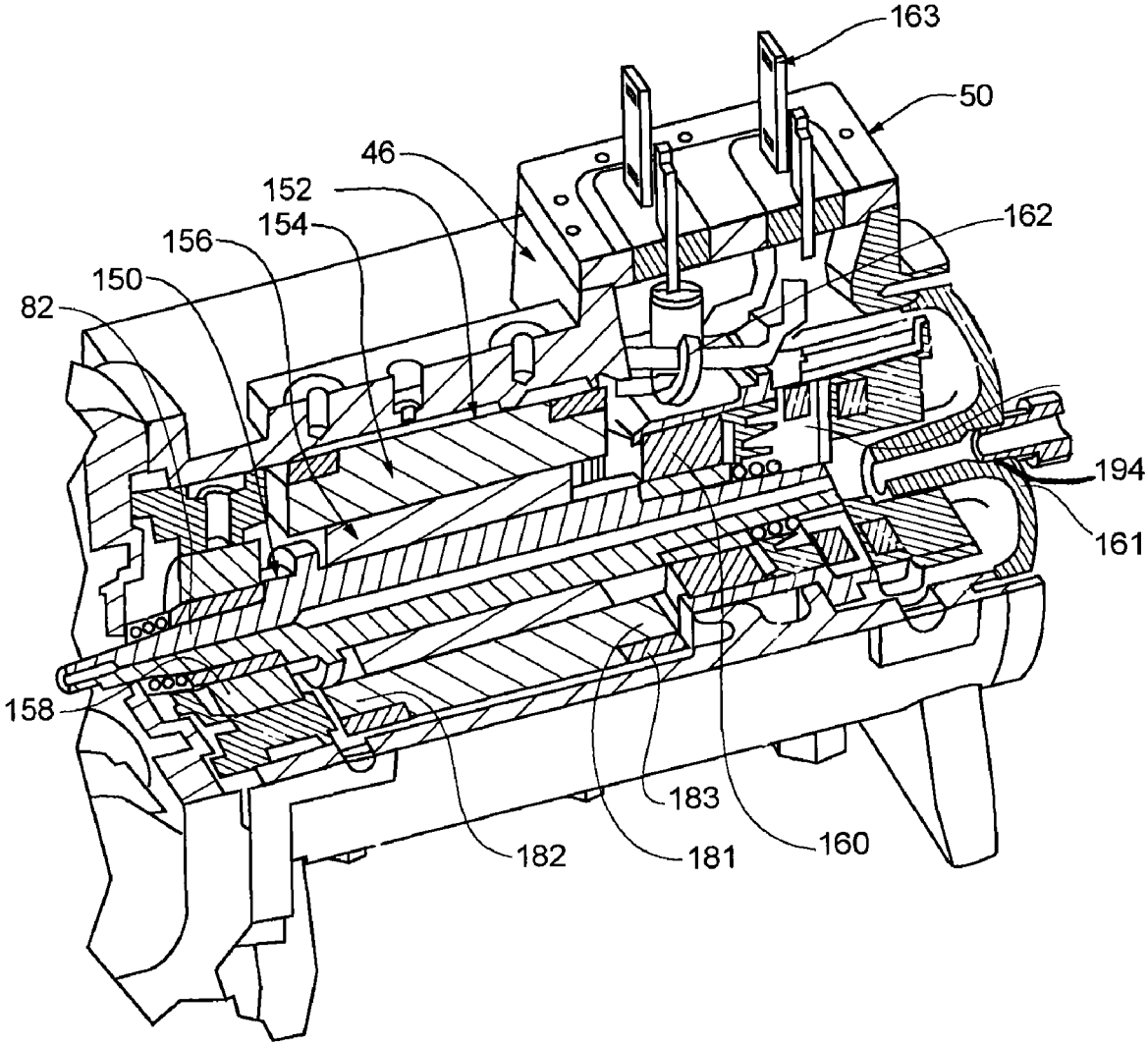
FIG. 4 is a perspective cut away view of a compressor drive train assembly in an embodiment of the invention.

Referring to FIG. 4, an embodiment of the motor housing 46 is portrayed containing a drive train 150 that includes a permanent magnet motor 152 having a stator assembly 154, a rotor assembly 156 mounted to a motor shaft 82, and oil-free, magnetic bearings 158 and 160 that suspend the motor shaft 82 during operation. The permanent magnet motor 152 may be powered through leads 162 connected to the stator assembly 154 via a terminal bus plate assembly 163.

Figure 5:
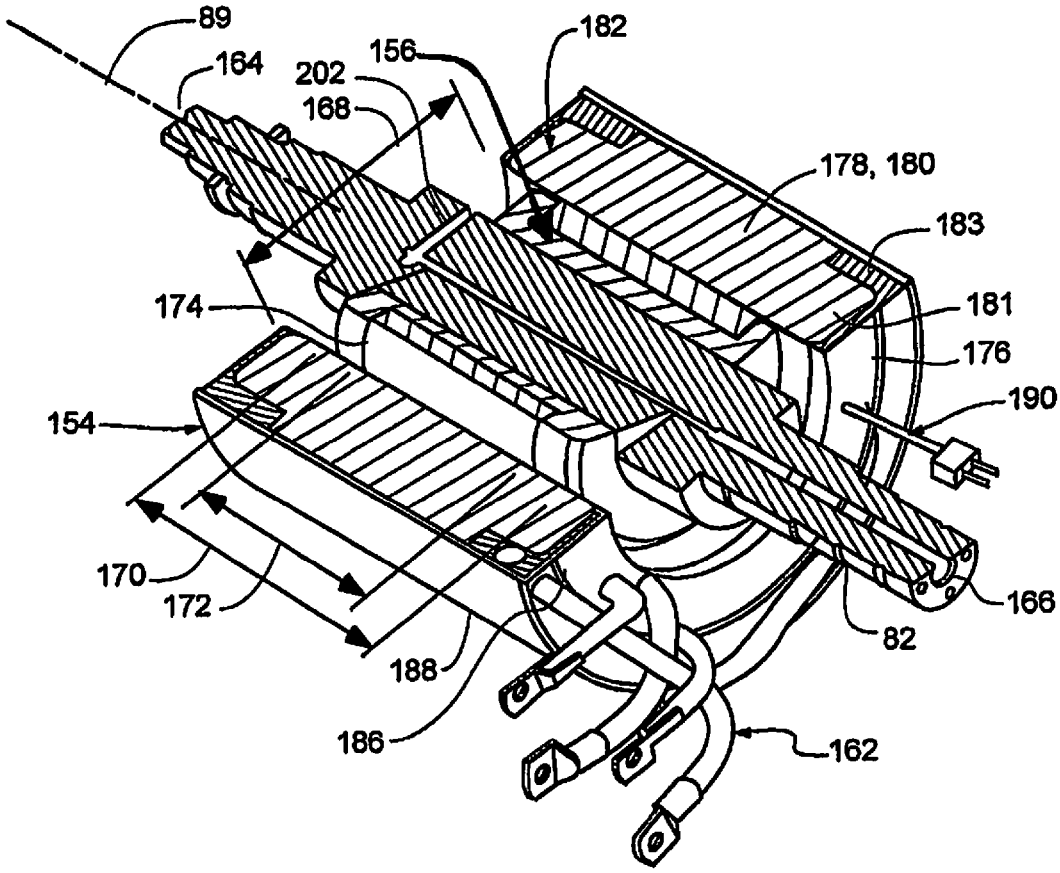
FIG. 5 is a cross-sectional view of the rotor and stator assemblies of the drive train assembly of FIG. 4.

Referring to FIG. 5, a rotor assembly 156 is portrayed in an embodiment of the invention. The motor shaft 82 includes a drive end 164 upon which the impeller 80 can be mounted, and a non-drive end 166 which extends into the motor housing 46. The rotor assembly 156 may be characterized by an internal clearance diameter 168 and an overall length 170 which may include an active length 172 over which a permanent magnetic material 174 can be deposited.

A 6-phase stator assembly 154 is also depicted in FIG. 5 in an embodiment of the invention. It is contemplated that that a 3-phase stator assembly could readily be used as well. In this embodiment, the stator assembly 154 is generally described as a hollow cylinder 176, with the walls of the cylinder comprising a lamination stack 178 and six windings 180 having end turn portions 181 and 182 encapsulated in a dielectric casting 183 such as a high temperature epoxy resin (best illustrated in FIG. 5). A total of six leads 162 (four of which are shown in FIG. 5), one for each of the six windings 180, extend from an end 186 of the hollow cylinder 176 in this configuration. A sleeve 188 may be included that extends over the outer surface of the hollow cylinder 176 and in intimate contact with the outer radial peripheries of both the lamination stack 178 and the dielectric castings 183. The sleeve 188 may be fabricated from a high conductivity, non-magnetic material such as aluminum, or stainless steel. A plurality of temperature sensors 190, such as thermocouples or thermisters, may be positioned to sense the temperature of the stator assembly 154 with terminations extending from the end 186 of the hollow cylinder 176.

Figure 6:
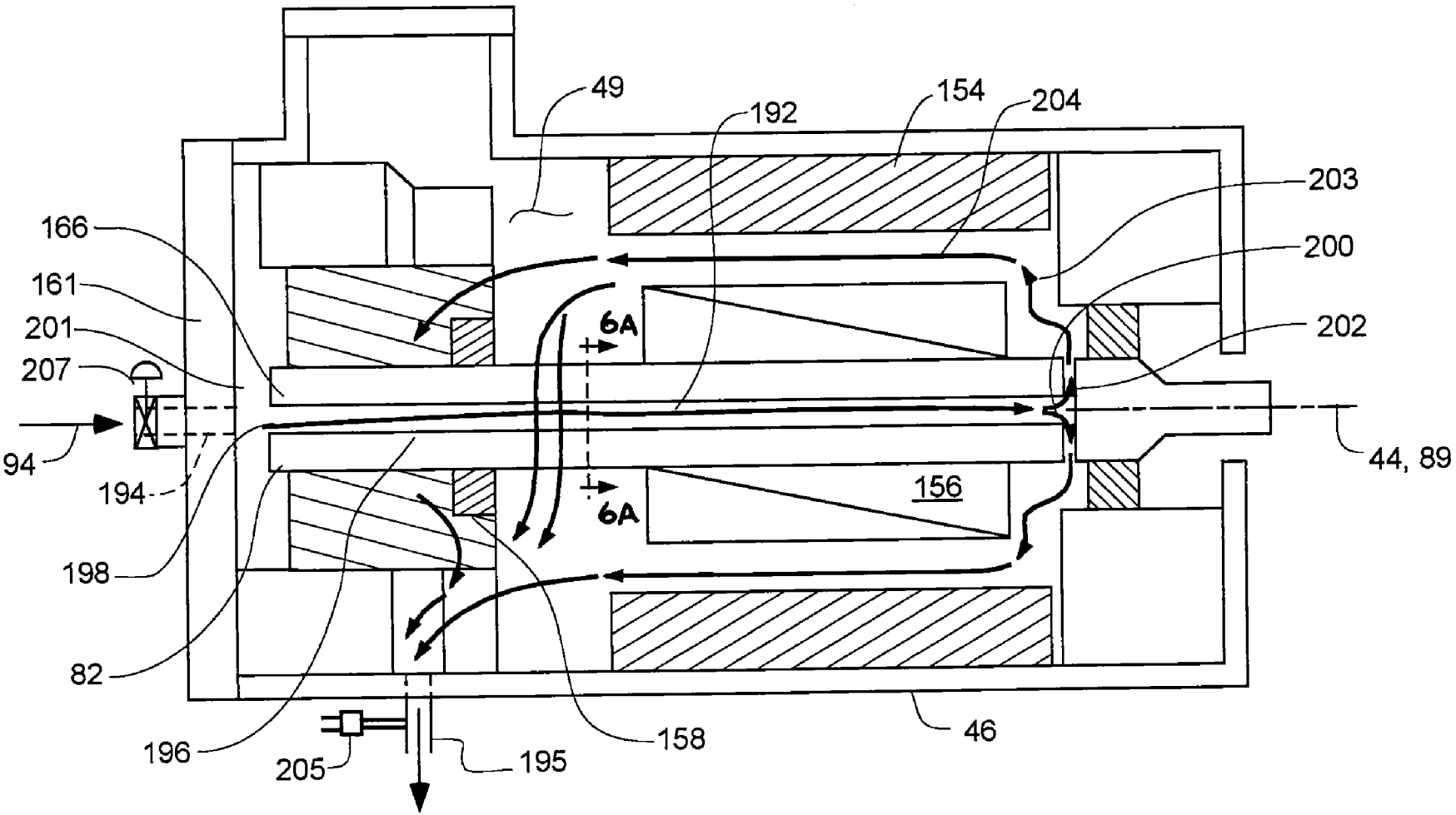
FIG. 6 is a cross-sectional view of the drive train assembly of FIG. 4 highlighting a gas bypass circuit for the rotor assembly of FIG. 5.
Figure 6A:
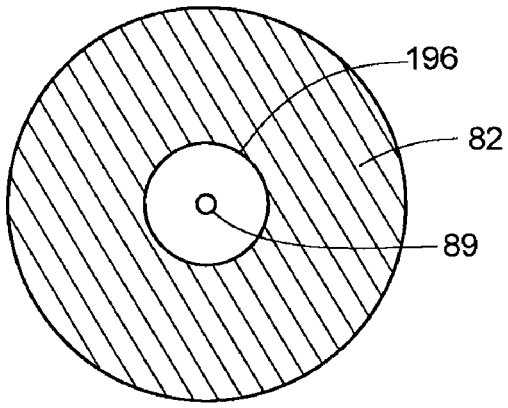
FIG. 6A is a sectional view of the motor shaft of FIG. 6.
Figure 6B:
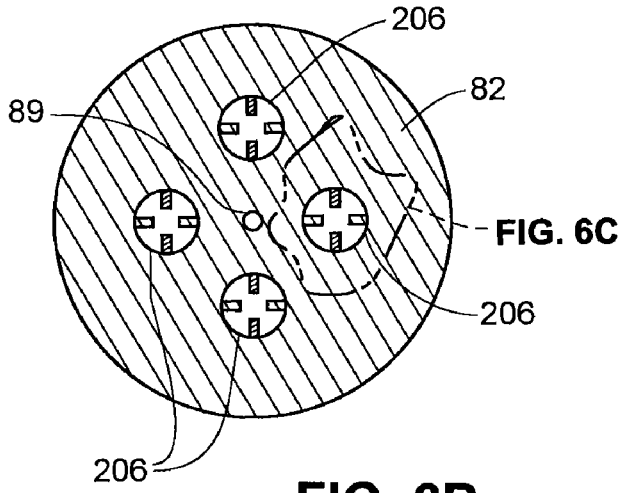
FIG. 6B is a sectional view of a motor shaft in an embodiment of the invention.
Figure 6C:
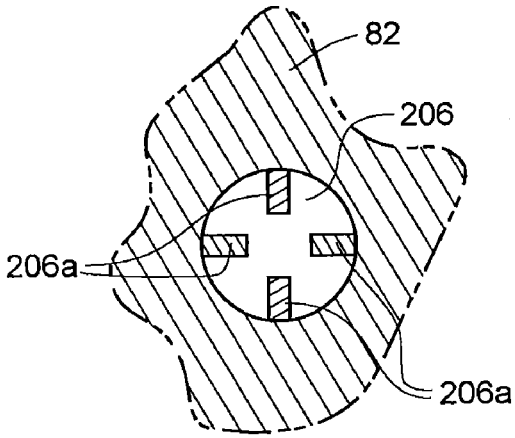
FIG. 6C is an enlarged partial sectional view of the motor shaft of FIG. 6B.

Referring to FIGS. 6, 6A and 6B, a rotor cooling circuit 192 is illustrated in an embodiment of the invention. The rotor cooling circuit 192 may be a subpart or branch of the gas bypass circuit 40 (FIG. 1). Refrigerant gas 94 from the evaporator section 34 may enter the rotor cooling circuit 192 through an inlet passage 194 formed on the end housing 161 and may exit via an outlet passage 195 formed on the motor housing 46. Accordingly, the rotor cooling circuit 192 may be defined as the segment of the gas bypass circuit 40 between the inlet passage 194 and the outlet passage 195. The inlet passage 194 may be in fluid communication with a longitudinal passage 196 that may be a center passage substantially concentric with the rotational axis 89 of the motor shaft 82. The longitudinal passage 196 may be configured with an open end 198 at the non drive end 166 of the motor shaft 82. The longitudinal passage 196 may pass through and beyond the portion of the motor shaft 82 upon which the rotor assembly 156 is mounted, and terminate at a closed end 200.

A plurality of flow passages 206 as depicted in FIG. 6B may be utilized that are substantially parallel with but not concentric with the rotational axis 89 of the motor shaft 82 in another embodiment of the invention. The flow passages 206 may replace the single longitudinal passage 196 of FIG. 6A as depicted, or may supplement the longitudinal passage 196. The plurality of passages may be in fluid communication with the aspiration passages 202.

The flow passage 206 may also include heat transfer enhancement structures, such as longitudinal fins 206*a* that extend along the length of and protrude into the flow passages 206. Other such heat transfer enhancement structures are available to the artisan, including but not limited to spiral fins, longitudinal or spiraled (rifling) grooves formed on the walls of the flow passages 206, or staggered structures. Such heat transfer enhancement structures may also be incorporated into the longitudinal passage 196 of FIGS. 6 and 6A.

The depiction of FIG. 6 portrays a gap 201 between the non drive end 166 of the motor shaft 82 and the end housing 161. In this configuration, refrigerant gas 94 is drawn through the inlet passage 194 and into the open end 198 of the longitudinal passage 196 from the interior chamber 49. Alternatively, the shaft may contact cooperating structures on the end housing 161, such as dynamic seals, so that the refrigerant gas 94 is ducted directly into the longitudinal passage 196.

In one embodiment, a plurality of radial aspiration passages 202 are in fluid communication with the longitudinal passage(s) 196 and/or 206 near the closed end 200, the aspiration passages 202 extending radially outward through the motor shaft 82. The aspiration passages 202 may be configured so that the gas refrigerant 94 exits into a cavity region 203 between the stator assembly 154 and the motor shaft 82. An annular gap 204 may be defined between the stator assembly 154 and the rotor assembly 156 to transfer the refrigerant gas 94. Generally, the rotor cooling circuit 192 of the gas bypass circuit 40 may be arranged to enable refrigerant gas to course over the various components housed between the rotor assembly 156 and the end housing 161 (e.g. magnetic bearing 158). The gas refrigerant 94 exiting the outlet passage 195 may be returned to the evaporator section 34. By this arrangement, components of the drive train 150 are in contact with cooling refrigerant in a vapor phase (gas refrigerant 94), and, under certain conditions, with refrigerant in a liquid phase.

In operation, the rotation of radial aspiration passages 202 within the motor shaft 82 acts as a centrifugal impeller that draws the gas refrigerant 94 through the gas bypass circuit 40 and cools the stator assembly 154. In this embodiment, gas residing in the aspiration passages 202 is thrown radially outward into the cavity 203, thereby creating a lower pressure or suction at the closed end 200 that draws the refrigerant gas 94 through the inlet passage 194 from the evaporator section 34. The displacement of the gas into the cavity 203 also creates and a higher pressure in the cavity 203 that drives the gas refrigerant 94 through the annular gap 204 and the outlet passage 195, returning to the evaporator section 34. The pressure difference caused by this centrifugal action causes the refrigerant gas 94 to flow to and from the evaporator section 34.

The cooling of the rotor assembly 156 may be enhanced in several respects over existing refrigeration compressor designs. The rotor assembly 156 is cooled along the length of the internal clearance diameter 168 by direct thermal conduction to the cooled motor shaft 82. Generally, the outer surface of the rotor assembly 156 is also cooled by the forced convection caused by the gas refrigerant 94 being pushed through the annular gap 204.

The throttling device 207 may be used to control the flow of gas refrigerant 94 and the attendant heat transfer thereto. The temperature sensing probe 205 may be utilized as a feedback element in the control of the flow rate of the refrigerant gas 94.

The use of the refrigerant gas 94 has certain advantages over the use of refrigerant liquid for cooling the rotor. A gas typically has a lower viscosity than a liquid, thus imparting less friction or aerodynamic drag over a moving surface. Aerodynamic drag reduces the efficiency of the unit. In the embodiments disclosed, aerodynamic drag can be especially prevalent in the flow through the annular gap 204 where there is not only an axial velocity component but a large tangential velocity component due to the high speed rotation of the rotor assembly 156.

The use of the plurality of flow passages 206 may enhance the overall heat transfer coefficient between the gas refrigerant 94 and the rotor assembly 156 by increasing the heat transfer area. The heat transfer enhancement structures may also increase the heat transfer area, and in certain configurations can act to trip the flow to further enhance the heat transfer. The conductive coupling between the flow passages 206 and the outer surface of the motor shaft 82 may also be reduced because the effective radial thickness of the conduction path may be shortened. The multiple passages may further provide the designer another set of parameters that can be manipulated or optimized to produce favorable Reynolds number regimes that enhance the convective heat transfer coefficient between the gas refrigerant 94 and the walls of the flow passages 206.

A throttling device 207 may be included on the inlet side (as depicted in FIG. 6) or the outlet side of the rotor cooling circuit 192 of the gas bypass circuit 40. The throttling device 207 may be passive or automatic in nature. A passive device is generally one that has no active feedback control, such as with a fixed orifice device or with a variable orifice device that utilizes open loop control. An automatic device is one that utilizes a feedback element in closed loop control, such as an on/off controller or a controller that utilizes proportional/integral/derivative control schemes.

The temperature of the gas refrigerant 94 exiting the rotor cooling circuit 192 may be monitored with a feedback element such as a temperature sensing probe 205. The feedback element may be used for closed loop control of the throttling device 207. Alternatively, other feedback elements may be utilized, such as a flow meter, heat flux gauge or pressure sensor.

Figure 7:
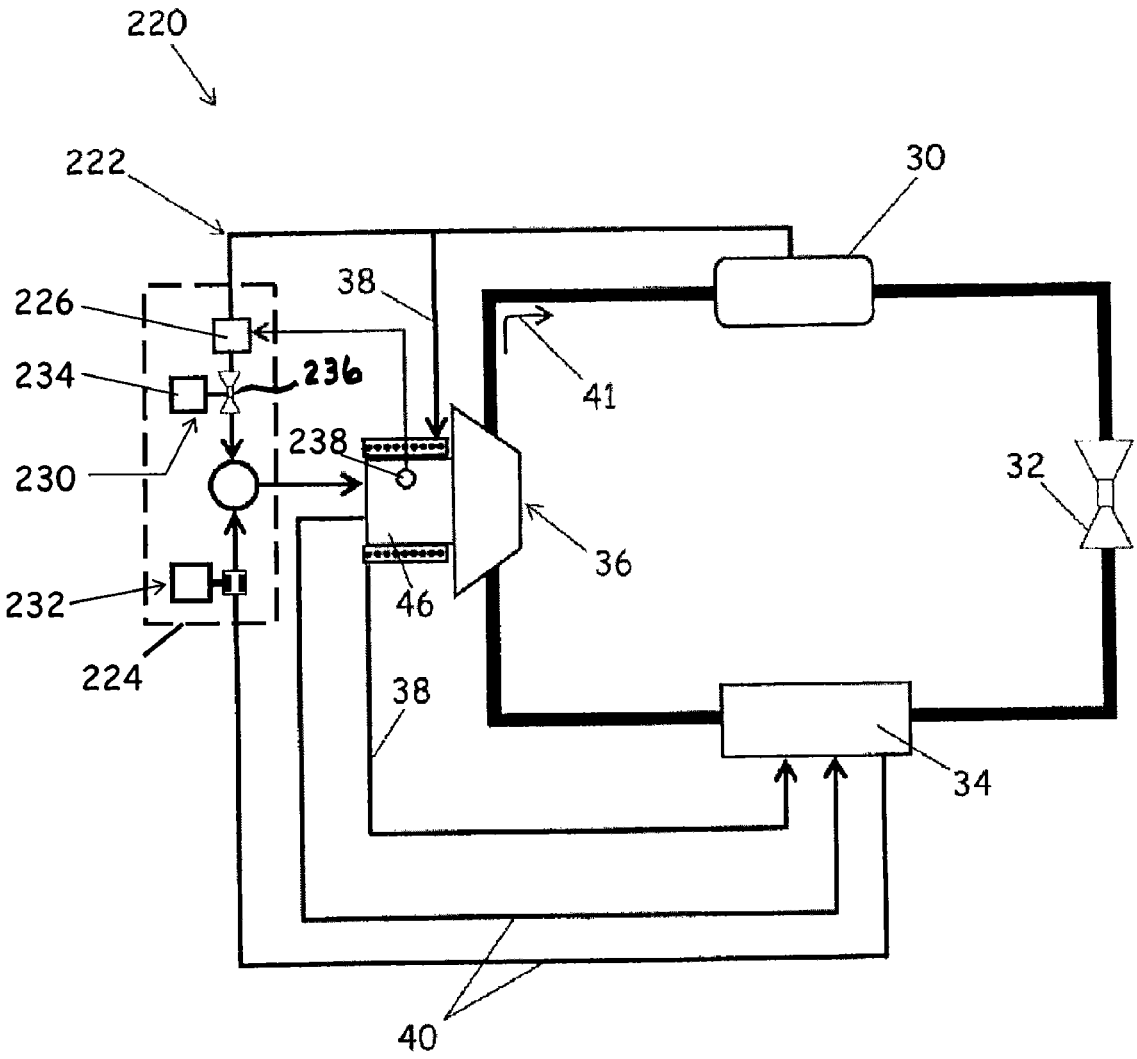
FIG. 7 is a schematic of a chiller system having a mixed phase injection circuit in an embodiment of the invention.

Referring to FIG. 7, a chiller system 220 that includes a mixed phase injection circuit 222 is depicted in an embodiment of the invention. In this embodiment, refrigerant gas from the gas evaporator section 34 is mixed with liquid refrigerant from the condenser section 30 before entering the inlet passage 194 of the motor housing 46. The mixed phase injection circuit 222 may include a mixer assembly 224. In one embodiment, the mixed phase injection circuit 222 of the mixer assembly 224 may comprise an on/off control 226 and an expansion device 230. The mixer assembly 224 may further include a throttling device 232 operatively coupled to the gas bypass circuit 40.

The on/off control 226 may comprise a valve that is actuated manually, remotely by a solenoid or stepper motor, passively with a valve stem actuator, or by other on/off control means available to the artisan. The expansion device 230 may be of a fixed type (e.g. orifice meter) sized to produce a range of flow rates corresponding to a range of inlet pressures. Alternatively, the expansion device 230 may include a variable orifice or variable flow restriction 236, and the flow controller 234 may include a closed loop control means that is operatively coupled with a feedback element or elements 238 (FIG. 7) for control of the variable flow restriction 236 to achieve a desired set point or set points.

Functionally, the mixed phase injection system 222 may act to augment the cooling effect of the rotor cooling circuit 192. As the mixed vapor/liquid refrigerant courses through the motor shaft 82, at least a portion of the liquid fraction of the vapor/liquid mixture may undergo a phase change, thus providing evaporative cooling of the longitudinal passage 196 or passages 206 of the motor shaft 82. The sensible heat removed by convective heat transfer is augmented by the latent heat removed by the phase change of the liquid refrigerant injected into the flow stream. In this way, the evaporative cooling can substantially increase the heat transfer away from the rotor assembly 156, thereby increasing the cooling capacity of the rotor cooling circuit 192.

Injection of the liquid/vapor mixture may be controlled using the flow controller 234. The feedback element(s) 238 may provide the flow controller 234 with an indication of the gas temperature at the rotor entrance or exit, the motor stator temperature, the interior chamber pressure, or some combination thereof. The flow controller 234 may be an on/off controller that activates or deactivates the mixed phase injection system 222 when the feedback element(s) 238 exceed or drop below some set point range. For example, where the feedback element(s) 238 are temperature sensors that monitor the stator and rotor temperatures, the flow controller 234 may be configured to activate the mixed phase injection system 222 when either of these temperatures rise above some setpoint. Conversely, if the rotor gas exit temperature becomes too low, the mixed phase injection system 222 can be deactivated, in which case the rotor may be cooled only by the vapor from the evaporator section 34.

Figure 7A:
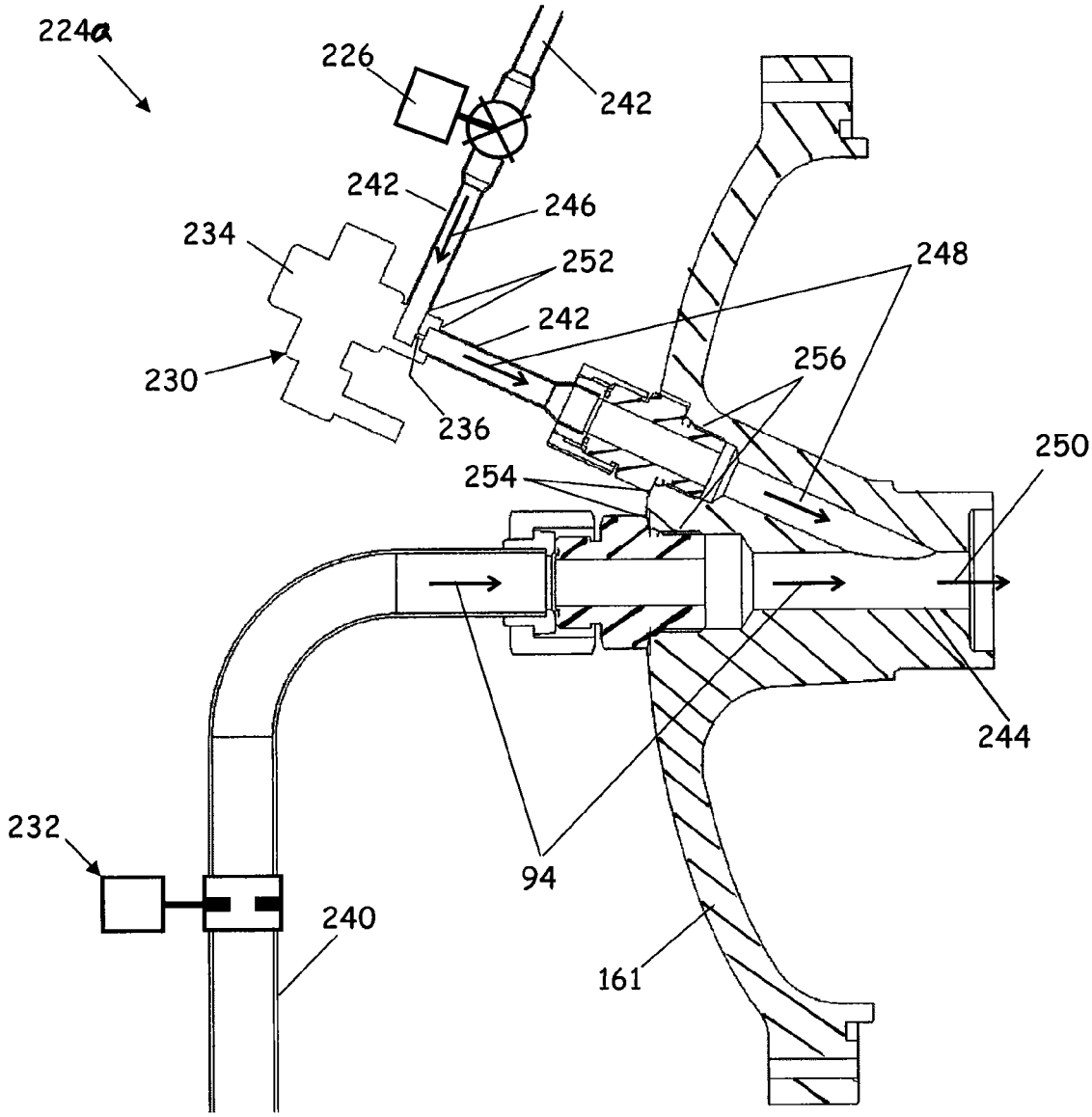
FIG. 7A through 7D are partial sectional views of mixer assembly configurations of FIG. 7 in various embodiments of the invention.
Figure 7B:
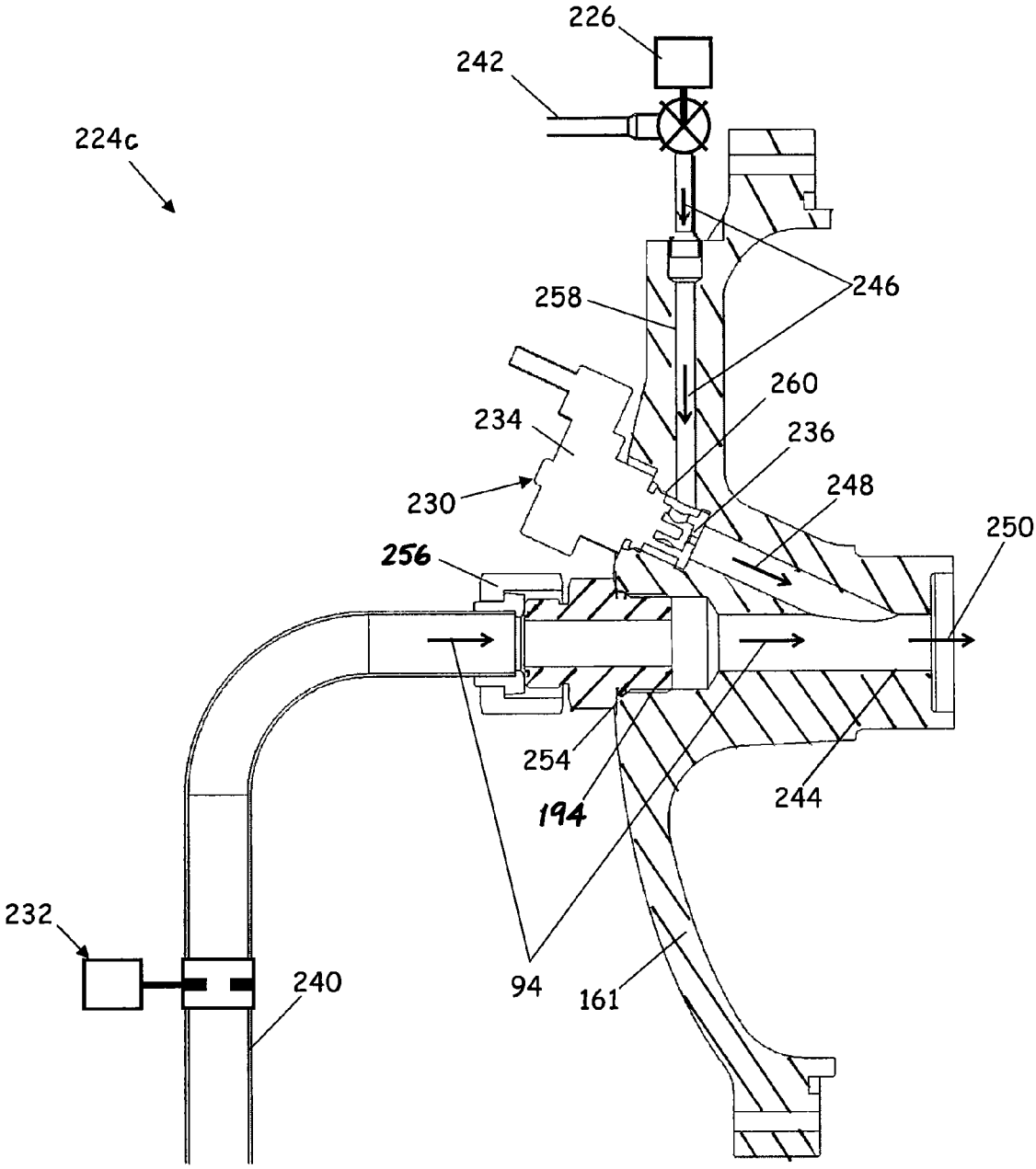
Figure 7C:
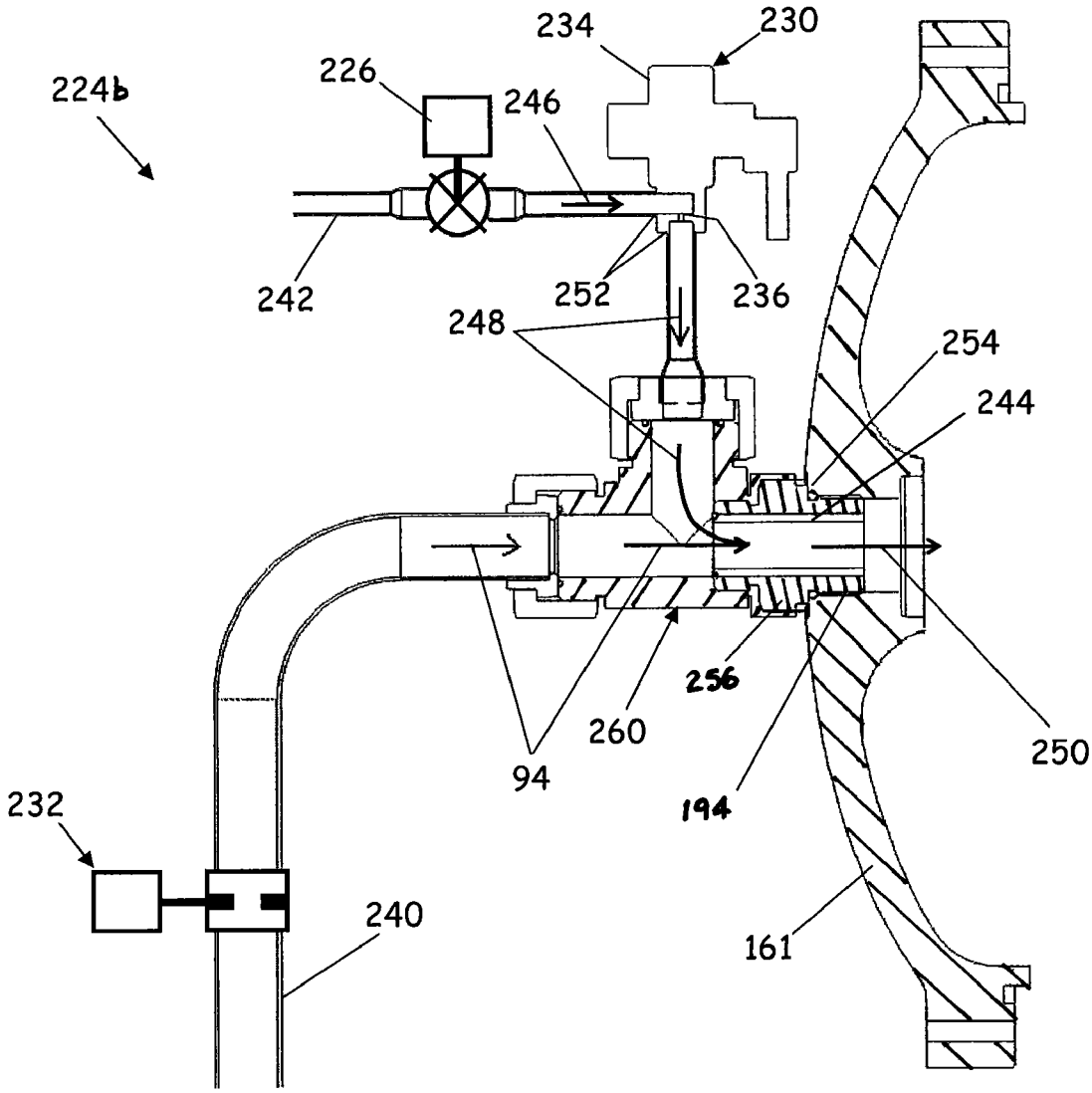

Referring to FIGS. 7A through 7D, configurations for the mixer assembly 224 (numbered 224*a* through 224*d*, respectively) are depicted in various embodiments of the invention. The expansion devices 230 depicted in FIGS. 7A, 7B and 7C are of a variable type, with the flow controller 234 comprising a motorized drive. The expansion device depicted in FIG. 7D comprises a fixed flow restriction device 264. The mixer assemblies 224*a* through 224*d* may be further characterized as having a gas refrigerant inlet or piping 240, a liquid refrigerant inlet or piping 242 and a mixing chamber 244.

Generally, a liquid refrigerant stream 246 is introduced into the liquid refrigerant inlet 242. The pressure of the liquid refrigerant stream 246 may drop to approximately the pressure of the evaporator section 34 (FIG. 7) after passing through the expansion device 230 or 264, with attendant transformation to a two-phase refrigerant stream 248. That is, the reduction in pressure of the liquid refrigerant may cause the refrigerant that passes therethrough, or a portion thereof, to change expand into a vapor state. The expansion also tends to reduce the temperature of refrigerant stream.

The quality (i.e. the mass fraction of refrigerant that is in the vapor state) of the two-phase refrigerant stream 248 varies generally with the pressure difference across and the effective size of the orifice or flow restriction 236 of the expansion device 230. Accordingly, for embodiments utilizing the expansion device 230 of variable flow restriction, the quality of the two-phase refrigerant stream 248 can be actively controlled.

The two-phase refrigerant stream 248 may be further mixed with the refrigerant gas 94 from the evaporator section 34 to produce a liquid/vapor mixture 250 that enters the motor housing 46 and the longitudinal passage 196 or passages 206 of the motor shaft 82 (FIG. 6). The mixing of the two-phase refrigerant stream 248 with the refrigerant gas 94 effectively produces a quality in the liquid/vapor mixture 250 that is somewhere between the quality of the stream 248 and the quality of the refrigerant gas 94.

The embodiment of FIG. 7A includes a "Y" configuration where the liquid refrigerant stream 246 and the refrigerant gas 94 meet at an angle in the mixing chamber 244. The refrigerant streams enter the end housing 161 through separate paths so that the mixing chamber 244 is contained within the end housing 161 of the motor housing 46 (FIG. 2). The on/off control 226 and the flow controller 234 are depicted as external to the end housing 161 with the flow controller 234 being joined to the liquid refrigerant piping 242 with brazed joints 252. A pair of seats 254 may be machined into the end housing 161 to accommodate threaded fittings 256, such as compression fittings (depicted) or pipe fittings.

The configuration of FIG. 7B resembles generally the "Y" configuration of FIG. 7A, but with the liquid refrigerant stream 246 entering the expansion device 230 through a port 258 that is formed within the casting of the end housing 161. The expansion device 230 is configured to accommodate a valve seat 260 machined into the end housing 161.

Functionally, the configuration of FIG. 7B provides the advantage of facilitating assembly and reducing the number of brazed joints external to the compressor. Also, the weight of the expansion device 230 and the on/off control 226 are supported directly by the end housing 161, thus reducing the stresses and vibrational characteristics that may be incurred by having these components cantilevered from external liquid refrigerant piping 242 as in the arrangement of FIG. 7A.

The configuration of FIG. 7C includes a "T" fitting 260 wherein the two-phase refrigerant stream 248 and the refrigerant gas 94 meet at a right angle prior to entering the mixing chamber 244. In this configuration, the mixing chamber 244 occupies the common leg of the "T" fitting 260. The configuration also utilizes a single inlet passage 194 of the motor housing 46, enabling mixing with a single compression fitting such as depicted in the embodiment of FIGS. 1 and 2.

Functionally, having the mixing chamber 244 outside end housing 161 takes up less space within the motor housing 46 for a more compact motor housing design. The right angle confluence of the two-phase refrigerant stream 248 and the refrigerant gas 94 promotes turbulence for enhanced mixing of liquid/vapor mixture 250 entering the motor housing 46.

Figure 7D:
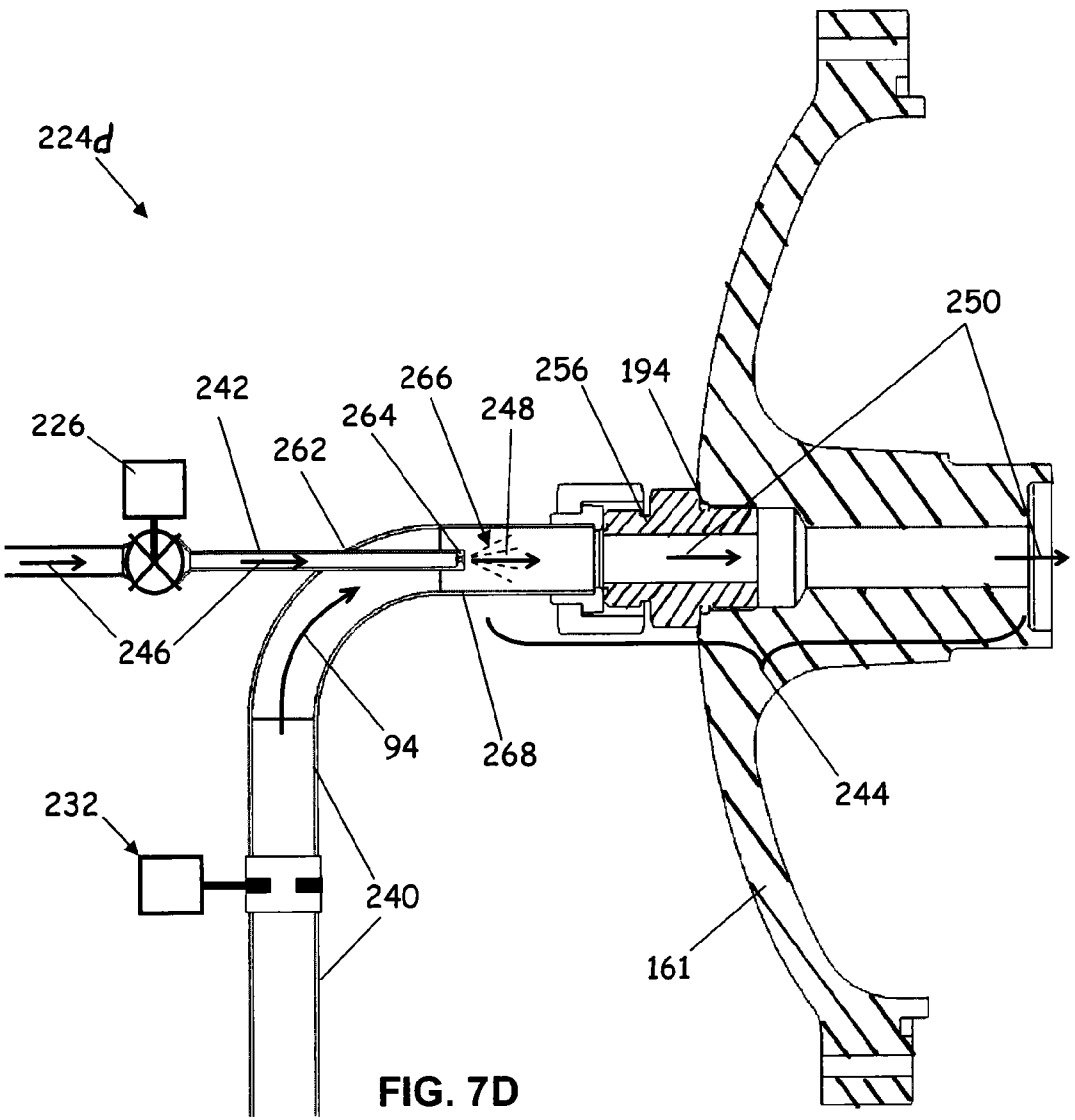

The configuration of FIG. 7D includes the liquid refrigerant inlet 242 in alignment with the single inlet passage 194 of the motor housing 46. The liquid refrigerant inlet passage 242 may be coupled to the gas refrigerant inlet or passage 240 with a brazed joint 262 as depicted, or the elbow of the gas refrigerant passage 240 may be cast with a port (not depicted) that aligns the liquid refrigerant inlet 242 coaxially with the gas refrigerant inlet 240 immediately upstream of the single inlet passage 194. In the depicted embodiment, the liquid refrigerant inlet 242 is configured as an injection tube for the liquid refrigerant stream 246, which is entrained with the refrigerant gas 94. The inlet 242 may include the fixed flow restriction device 264 that expands the liquid refrigerant stream 246 into a fine mist or spray 266 to produce the two-phase refrigerant stream 248 that becomes entrained in the refrigerant gas 94. Alternatively, the fixed flow restriction device 264 can work in conjunction with an orifice a variable flow restriction device (e.g. variable flow restriction 236 of FIGS. 7A-7C) located upstream of the fixed flow restriction device 264. Also, FIG. 7D depicts the mixing chamber 244 as having an extended length in comparison to the FIGS. 7A-7C embodiments, the extended length comprising a distal portion 268 of the liquid refrigerant inlet 242 and the inlet passage 194. The fixed flow restriction device 264 may comprise an orifice or an atomizer nozzle.

Functionally, the configuration of FIG. 7D may direct the refrigerant in the direction of gas flow and minimize backflow into the evaporator. The fine mist or spray 266 may tend to promote suspension of the liquid refrigerant stream 246 within the two-phase refrigerant stream 248. The extended length of the mixing chamber 244 may promote a more uniform mixing of the two-phase refrigerant stream 248 before entering the motor housing 46.

A concern with mixed phase or two-phase cooling is incomplete evaporation of the liquid component of the liquid/vapor mixture within the longitudinal passage 196 or passages 206, which generally occurs when the heat transfer to the liquid/vapor mixture is insufficient to vaporize the liquid component, either due to insufficient heat generation within the rotor assembly 156 or due to inefficiencies in the heat transfer mechanism to the liquid/vapor mixture. The consequence of incomplete evaporation can be the collection of liquid refrigerant within the longitudinal passage 196 or passages 206 that results in droplets being thrown out of the aspiration passages 202 and impinging on surfaces and components. The impingement may cause erosion of the subject surfaces and components.

Moreover, conditions that cause the onset of droplet formation can be a function of many parameters, including but not necessarily limited to the temperature of the motor shaft 82, the temperature, pressure and flow rate of the liquid/vapor mixture and the refrigerant gas 94, and the quality of the liquid/vapor mixture.

Prevention of the formation of liquid droplets may be accomplished several ways. In one embodiment, a sight glass may be located on the motor housing 46 for visual inspection of the interior chamber 49 for droplet formation. Adjustments may be made until droplet formation is sufficiently mitigated. Use of the sight glass may include simple visual inspection of the sight glass itself for formation of liquid refrigerant thereon. More complicated uses may include laser probing and measurement of scattered light that is caused by droplet formation.

Another approach is to have the flow controller 234 monitor the pressure and temperature of the interior chamber 49 and to respond so that conditions therein are comfortably above the onset of liquid formation, in accordance with table data for the appropriate refrigerant. The pressure and temperature measurement could be performed within or proximate to the cavity region 203. Alternatively, the pressure may taken at a location where a pressure is already measured and is known to be similar to the pressure of the cavity region 203 (such as at the evaporator). A correlation between the similar pressure and the pressure of the cavity region 203 could then be established by experiment or by prototype testing, thus negating the need for an additional pressure measurement.

Another approach is to correlate the temperature of the refrigerant gas 94 provided by the temperature sensing probe 205 to the temperature of the refrigerant gas 94 in the cavity region 203. The correlation could be established experimentally during prototype testing. The correlation could be expanded to include measured indications of flow rate and pressure in addition to the temperature for a more refined determination of the state of the refrigerant exiting the rotor.

Figure 8:
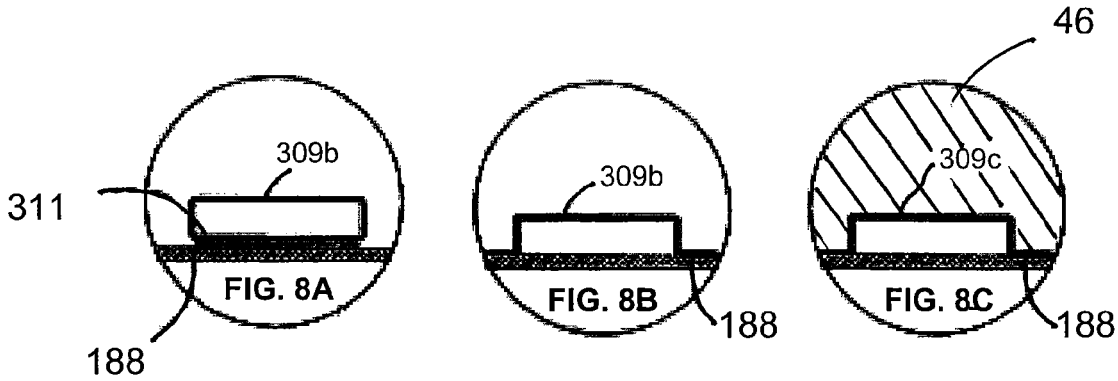
FIG. 8 is a sectional view of a compressor assembly highlighting a liquid bypass circuit for the stator assembly of the drive train assembly of FIG. 4.
Figure 8:
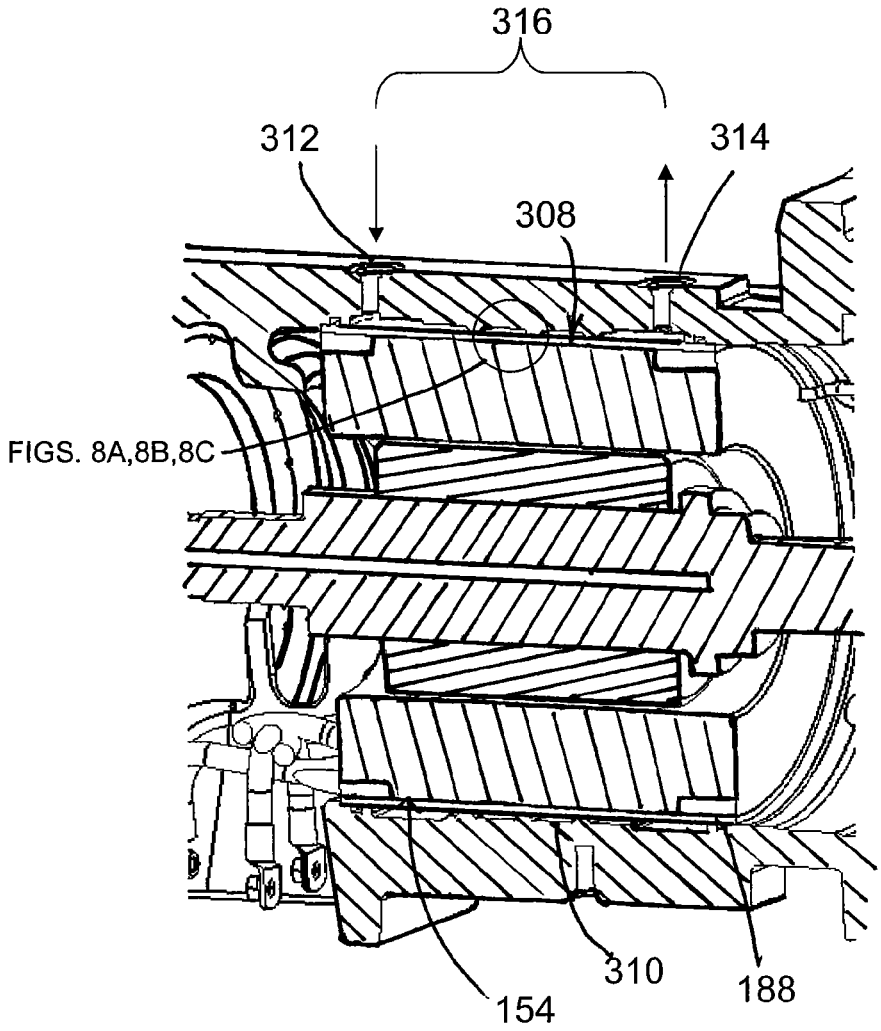

Referring to FIGS. 8 and 8A, a stator cooling section 308 of the liquid bypass circuit 38 for cooling of the stator assembly 154 is highlighted in an embodiment of the invention. The stator cooling section 308 may comprise a tubing 309*a* that defines a spiral passageway 310 formed on the exterior of the sleeve 188. Heat transfer to the refrigerant flowing in the tubing 309*a* may be augmented with a thermally conductive interstitial material 311 between the tubing 309*a* and the sleeve 188. The tubing 309*a* may be secured to the sleeve 188 by welding, brazing, clamping or other means known to the artisan.

Referring to FIG. 8B, the spiral passageway 310 may comprise a channel 309*b* that enables a liquid refrigerant 316 flowing therein to make direct contact with the sleeve 188. The channel 309*b* may be secured to the sleeve 188 by welding, brazing or other techniques known to the artisan that provide a leak tight passageway. The liquid refrigerant 316 may be sourced from the liquid bypass circuit 38 as depicted in FIGS. 1 and 7.

Referring to FIG. 8C, the spiral passageway 310 may comprise a channel 309*c* formed on the interior surface of the motor housing 46 and the outer surface of the sleeve surrounding the stator 154. Accordingly, this spiral passageway 310 is defined upon assembly of the compressor. The channel 309*c* enables a liquid refrigerant 316 flowing therein to directly contact the sleeve 188 for efficient cooling of the stator 154. As in other embodiments discussed, liquid refrigerant 316 may be sourced from the liquid bypass circuit 38 (FIGS. 1 and 7).

It is further noted that the invention is not limited to a spiral configuration for the stator cooling section 308. Conventional cylindrical cooling jackets, such as the PANELCOIL line of products provided by Dean Products, Inc. of Lafayette Hill, Pa., may be mounted onto the sleeve 188, or even supplant the need for a separate sleeve.

The spiral passageway 310 can be configured for fluid communication with a liquid cooling inlet port 312 through which the refrigerant liquid 316 is supplied and a liquid cooling outlet port 314 through which the refrigerant liquid 316 is returned. The liquid cooling inlet port 312 may be connected to the condenser section 30 of the refrigeration circuit, and the liquid cooling outlet port 314 may be connected to the evaporator section 34. The refrigerant liquid 316 in this embodiment is motivated to pass from the condenser section 30 to the evaporator section 34 (FIG. 1) because of the higher operating pressure of the condenser 30 section relative to the evaporator section 34.

A throttling device (not depicted) may be included on the inlet side or the outlet side of the stator cooling section 308 to regulate the flow of liquid refrigerant therethrough. The throttling device may be passive or automatic in nature.

The drive train 150 may be assembled from the non drive end 166 of the motor shaft 82. Sliding the rotor assembly 156 over the non drive end 166 during assembly (and not the drive end 164) may prevent damage to the radial aspiration passages 202.

Functionally, the permanent magnet motor 152 may have a high efficiency over a wide operating range at high speeds, and combine the benefits of high output power and an improved power factor when compared with induction type motors of comparable size. The permanent magnet motor 152 also occupies a small volume or footprint, thereby providing a high power density and a high power-to-weight ratio. Depending on the materials used, the compressor can weigh less than 2500 pounds and, in one embodiment, the compressor weighs approximately 800 pounds. Various embodiments of the assembled motor housing 46, discharge housing 54 and inlet housing 58 can fit within a space measuring approximately 45 inches long by 25 inches high by 25 inches wide. Also, the motor shaft 82 may serve as a direct coupling between the permanent magnet motor 152 and the impeller 80 of the aerodynamic section 42. This type of arrangement is herein referred to as a "direct drive" configuration. The direct coupling between the motor shaft and the impeller 80 eliminates intermediate gearing that introduces transfer inefficiencies, requires maintenance and adds weight to the unit. Those skilled in the art will recognize that certain aspects of the disclosure can be applied to configurations including a drive shaft that is separate and distinct from the motor shaft 82.

As disclosed in one embodiment, the stator assembly 154 may be cooled by the liquid refrigerant 316 that enters the spiral passageway 310 as a liquid. However, as the liquid refrigerant 316 courses through the stator cooling section 308, a portion of the refrigerant may become vaporized, creating a two phase or nucleate boiling scenario and providing very effective heat transfer.

The liquid refrigerant 316 may be forced through the liquid bypass circuit 38 and the stator cooling section 308 because of the pressure differential that exists between the condenser section 30 and the evaporator section 34. The throttling device (not depicted) passively or actively reduces or regulates the flow through the liquid bypass circuit 38. The temperature sensors 190 may be utilized in a feedback control loop in conjunction with the throttling means.

The sleeve 188 may be fabricated from a high thermal conductivity material that thermally diffuses the conductive heat transfer and promotes uniform cooling of the outer peripheries of both the lamination stack 178 and the dielectric castings 183. For the spiral wound channel 309*b* configuration, the sleeve 188 further serves as a barrier that prevents the liquid refrigerant 316 from penetrating the lamination stack 178.

The encapsulation of the end turn portions 181, 182 of the stator assembly 154 within the dielectric castings 183 serves to conduct heat from the end turn portions 181, 182 to the stator cooling section 308, thereby reducing the thermal load requirements on the rotor cooling circuit 192 of the gas bypass circuit 40. The dielectric castings 183 include material which flows through the slots in the stator and fully encapsulates the end turns. The dielectric casting 183 can also reduce the potential for erosion of the end turn portions 181, 182 exposed to the flow of the gas refrigerant 94 through the rotor cooling circuit 192.

Alternatively, cooling of the stator assembly can incorporate two-phase flow in the stator cooling section 308. The two-phase mixture can be generated by an orifice located in the liquid bypass circuit 38, akin to the devices and methods described above for cooling the rotor. For example, the orifice may be a fixed orifice located upstream of the stator cooling section 308 that causes the refrigerant to expand rapidly into a two-phase (aka "flash") mixture. In another embodiment, a variable orifice can be utilized upstream of the stator cooling section 308, which may have generally the same effect but enabling active control of the coolant flow rate and the quality of the two-phase mixture, which may further enable control of the motor temperature. Feedback temperatures for control of the variable orifice may be provided, such as stator winding temperature, stator cooling circuit refrigerant temperature, casing temperatures, or combination thereof.

In yet another embodiment, a fixed or variable orifice metering device on the downstream side of the stator cooling section 308 thus may be provided to restrict the flow enough to allow the onset of nucleate boiling within the passageways (e.g. 309*a*, 309*b*) and enhancing the heat transfer versus single phase cooling (sensible heat transfer).

Various methods for operation of high capacity chiller systems such as the one described in this application are possible. One method includes providing a centrifugal compressor assembly for compression of a refrigerant in a refrigeration loop. Specifically, the refrigeration loop includes an evaporator section containing a refrigerant gas and a condenser section containing a refrigerant liquid. Also, the centrifugal compressor includes a rotor assembly operatively coupled with a stator assembly. The rotor assembly includes structure that defines a flow passage therethrough, and the centrifugal compressor includes a refrigerant mixing assembly operatively coupled with the evaporator section, the condenser section and the rotor assembly.

The method includes transferring said refrigerant liquid from the condenser section to the refrigerant mixing assembly and transferring the refrigerant gas from the evaporator section to the refrigerant mixing assembly. The refrigerant mixing assembly is used to mix said refrigerant liquid with the refrigerant gas from the steps of transferring to produce a gas-liquid refrigerant mixture. The gas-liquid refrigerant mixture is routed through the flow passage of the rotor assembly to provide two-phase cooling of the rotor assembly.

The centrifugal compressor assembly provided may include the stator assembly being operatively coupled with said condenser section. The stator assembly may include structure that defines a cooling passage operatively coupled thereto. The method may comprise transferring the refrigerant liquid from the condenser section to the cooling passage of the stator assembly to cool the stator assembly.

The invention may be practiced in other embodiments not disclosed herein. References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the invention, it is expressly intended that the provisions of Section 112, sixth paragraph of 35 U.S.C. are not to be invoked unless the specific terms "means for" or "step for" are recited in the subject claim.

What is claimed is:

1. A chiller system comprising: a compressor assembly including a motor and an aerodynamic section, said motor including a rotor assembly operatively coupled with a motor shaft and a stator assembly to produce rotation of said motor shaft, said motor shaft and said aerodynamic section being arranged for direct drive of said aerodynamic section; a condenser section and an evaporator section, each operatively coupled with said aerodynamic section, said condenser section having a higher operating pressure than said evaporator section; a liquid bypass circuit that cools said stator assembly and said rotor assembly with a liquid refrigerant, said liquid refrigerant being supplied by said condenser section and returned to said evaporator section, said liquid refrigerant being motivated through said liquid bypass circuit by said higher operating pressure of said condenser section relative to said evaporator section; a gas bypass circuit that cools said rotor assembly with a gas refrigerant, said gas refrigerant being drawn from said evaporator section and returned to said evaporator section by pressure differences caused by said rotation of said motor shaft, and wherein said gas refrigerant from said evaporator section is mixed with said liquid refrigerant from said condenser section before entering said motor.

2. The chiller system of claim 1, wherein a flow restriction device is disposed between said condenser section and said aerodynamic section.

3. The chiller system of claim 1, further including structure defining a passageway located around the stator assembly for liquid cooling.

4. The chiller system of claim 1, wherein a central longitudinal passage is defined within the motor shaft for cooling said rotor assembly.

5. The chiller system of claim 1, wherein the temperature of said gas refrigerant in said gas bypass circuit is monitored by a feedback element.

6. The chiller system of claim 1 wherein said motor is a permanent magnet motor, said permanent magnet motor adapted to provide power exceeding approximately 140 KW of power, speeds in excess of 11,000 revolutions per minute, and at least a 200-ton refrigeration capacity at standard industry rating conditions.

7. The chiller system of claim 6 wherein said compressor assembly further comprises a discharge housing and an inlet housing, wherein the assembly of said motor housing, said discharge housing and said inlet housing fits within dimensions of 45 inches length by 25 inches width by 25 inches height.

8. The chiller system of claim 6 wherein said compressor assembly weighs less than 2500 pounds.

9. The chiller system of claim 1 wherein said motor shaft is supported by magnetic bearings.

10. The chiller system of claim 1, wherein the motor housing is made of aluminum alloy components.

* * * * *

UNITED STATES PATENT AND TRADEMARK OFFICE

CERTIFICATE OF CORRECTION

PATENT NO. : 8,397,534 B2
APPLICATION NO. : 12/404040
DATED : March 19, 2013
INVENTOR(S) : Mark C. Doty et al.

It is certified that error appears in the above-identified patent and that said Letters Patent is hereby corrected as shown below:

In the Specification

Column 8, line 18
Delete the word "length" which sits between two sentences.

Column 9, line 43
The word "that" is duplicated, please remove the second occurrence.

Column 10, line 66
Delete the word "and".

Column 12, line 64
Delete the word "change".

Signed and Sealed this
Seventh Day of October, 2014

Michelle K. Lee

Michelle K. Lee
*Deputy Director of the United States Patent and Trademark Office*